US012599203B2

(12) United States Patent
Kim et al.

(10) Patent No.: US 12,599,203 B2
(45) Date of Patent: Apr. 14, 2026

(54) DETACHABLE WEARING MEMBER AND WEARABLE ELECTRONIC DEVICE INCLUDING SAME

(71) Applicant: Samsung Electronics Co., Ltd., Gyeonggi-do (KR)

(72) Inventors: Jinwook Kim, Gyeonggi-do (KR); Insik Chung, Gyeonggi-do (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 514 days.

(21) Appl. No.: 17/891,372

(22) Filed: Aug. 19, 2022

(65) Prior Publication Data

US 2023/0056946 A1 Feb. 23, 2023

Related U.S. Application Data

(63) Continuation of application No. PCT/KR2022/011329, filed on Aug. 1, 2022.

(30) Foreign Application Priority Data

Aug. 19, 2021 (KR) ..... 10-2021-0109375

(51) Int. Cl.
*A44C 5/18* (2006.01)

(52) U.S. Cl.
CPC ..... *A44C 5/18* (2013.01)

(58) Field of Classification Search
CPC ..... A44C 5/18; A44C 5/147; G04B 37/1486
(Continued)

(56) References Cited

U.S. PATENT DOCUMENTS 3,581,960 A * 6/1971 Ojima ..... A44C 5/145 24/265 WS
8,763,868 B2 * 7/2014 El Kadiri ..... G04B 37/1486 368/282

(Continued)

FOREIGN PATENT DOCUMENTS

CN 112754118 A 5/2021
EP 1785784 A2 * 5/2007 ..... G04B 37/1493

(Continued)

OTHER PUBLICATIONS

International Search Report dated Oct. 28, 2022.
Korean Office Action for KR Application No. 10-2021-0109375 mailed on Jan. 19, 2026.

*Primary Examiner* — Regis J Betsch
*Assistant Examiner* — Kevin Andrew Johnston
(74) *Attorney, Agent, or Firm* — CANTOR COLBURN LLP

(57) ABSTRACT

A wearing member of a wearable electronic device may have a housing, the wearing member may have a holder body fixed to the housing of the wearable electronic device, the holder body defining a guide recess, a holder member including a fixing portion that protrudes at least partially from a surface of the holder body, a portion of the holder member being engaged in a recess of a side surface of the housing of the wearable electronic device such that the holder member is secured to the holder body, and a rotation member that is pivotably coupled to the holder body, the rotation member including a first portion that includes a guide protrusion that engages the guide recess and a second portion that is couplable to a wearable strap.

20 Claims, 14 Drawing Sheets

(58) Field of Classification Search
USPC ..... 368/282
See application file for complete search history.

(56) References Cited

U.S. PATENT DOCUMENTS

| | | | | |
|---|---|---|---|---|
| 9,756,907 | B2 * | 9/2017 | Frei | A44C 5/145 |
| 2001/0016971 | A1 * | 8/2001 | Guyard | G04B 37/1486 24/365 |
| 2008/0106980 | A1 | 5/2008 | Guillaume | |
| 2010/0238770 | A1 * | 9/2010 | Speichinger | G04B 37/1486 368/282 |
| 2013/0003510 | A1 * | 1/2013 | Speichinger | G04B 37/1486 224/267 |
| 2014/0098649 | A1 * | 4/2014 | Tschumi | G04B 37/1486 368/282 |
| 2016/0070234 | A1 | 3/2016 | Lee et al. | |
| 2017/0079386 | A1 | 3/2017 | de Iuliis et al. | |
| 2018/0011448 | A1 * | 1/2018 | Von Allmen | G04B 37/1493 |
| 2019/0053584 | A1 | 2/2019 | Perkins et al. | |
| 2019/0191828 | A1 * | 6/2019 | Wang | G04B 37/08 |
| 2020/0142358 | A1 * | 5/2020 | Taniguchi | A44C 5/14 |
| 2020/0209807 | A1 | 7/2020 | Lazzari | |

FOREIGN PATENT DOCUMENTS

| | | | |
|---|---|---|---|
| JP | 07-231802 | A | 9/1995 |
| JP | 5831846 | B2 | 12/2015 |
| JP | 3203156 | U | 2/2016 |
| JP | 2020-74841 | A | 5/2020 |
| KR | 10-2016-0028664 | A | 3/2016 |
| KR | 10-2016-0100732 | A | 8/2016 |
| KR | 10-2020-0083227 | A | 7/2020 |

* cited by examiner

DETACHABLE WEARING MEMBER AND WEARABLE ELECTRONIC DEVICE INCLUDING SAME

CROSS-REFERENCE TO RELATED APPLICATIONS

This application is a continuation of International Application No. PCT/KR2022/011329 designating the United States, filed on Aug. 1, 2022, in the Korean Intellectual Property Receiving Office and claiming priority to Korean Patent Application No. 10-2021-0109375, filed on Aug. 19, 2021, in the Korean Intellectual Property Office, the disclosures of which are incorporated by reference herein in their entireties.

BACKGROUND

1. Field

The disclosure generally relates to an electronic device, and more particularly to a detachable wearing member and a wearable electronic device including the same.

2. Description of Related Art

An electronic device may refer to a device performing a designated function according to an electronic program. The electronic device may be, for example, a home appliance, an electronic scheduler, a portable multimedia player, a mobile communication terminal, a tablet PC, a video/sound device, a desktop PC or laptop computer, a navigation for automobile, etc. Electronic devices are highly integrated, and high-speed, high-volume wireless communication becomes commonplace, a small electronic device, such as a mobile communication terminal, may be equipped with certain functions. For example, an electronic device may include integrated functionality, including an entertainment function, such as playing video games, a multimedia function, such as replaying music/videos, a communication and security function for mobile banking, and/or a scheduling or e-wallet function.

Recently, wearable electronic devices that may be worn on the human body are commercially available, and mobile communication terminals are also routinely used. A wearable electronic device may remain in contact with the user's body for a long time and may thus be useful for medical or healthcare purposes. For example, an electronic device may be equipped with sensors to detect the user's biometric information, such as photoplethysmograph (PPG), sleep interval, skin temperature, heart rate or electrocardiogram. The detected biometric information may be stored in the electronic device or transmitted to a medical institution in real time to be utilized for healthcare of the user. In general, an electronic device has a bar shape, a box shape, or a flat plate shape, but a wearable electronic device may be composed of multiple segments considering wearing convenience and the user's body curves. For example, a wrist-type wearable electronic device may include a housing, which serves as a main body to house certain circuit devices, and at least one wearing member, and a face-worn electronic device may include lenses corresponding to the user's eyes and at least one temple.

Despite a significant advance in wearable electronic devices, enough to be carried or used while worn on the user's body, users' demand for wearable electronic devices which are lightweight and more comfortably wearable has been further increased. Also increasing is users' demand for usability as an accessory for expressing their individuality, as well as the functions or capability of the wearable electronic device as it is carried and used, worn on the user's body.

The above-described information may be provided as background for the purpose of helping understanding of the disclosure. No claim or determination is made as to whether any of the foregoing is applicable as background art in relation to the disclosure.

SUMMARY

According to certain embodiments of the disclosure, to address at least the foregoing issues and/or drawbacks and to provide advantages described below, and a wearable electronic device may be lightened and may facilitate attachment and detachment of a wearing member.

According to certain embodiments of the disclosure, a wearable electronic device may facilitate attachment and detachment of a wearing member and may remain in a stable wearing state.

According to certain embodiments of the disclosure, a wearable electronic device may facilitate expressing the user's individuality by facilitating attachment and detachment of a wearing member.

In an embodiment, a wearing member of a wearable electronic device may have a housing, the wearing member that includes a holder body fixed to the housing of the wearable electronic device, the holder body defining a guide recess; a holder member including a fixing portion that protrudes at least partially from a surface of the holder body, a portion of the holder member being engaged in a recess of a side surface of the housing of the wearable electronic device such that the holder member is secured to the holder body, and a rotation member that is pivotably coupled to the holder body, the rotation member including a first portion that includes a guide protrusion that engages the guide recess and a second portion that is couplable to a wearable strap. The holder member may include a support protruding from a surface of the fixing portion and disposed to be exposed to the other side of the holder body to face the rotation member. As the rotation member pivots about the holder body, a gap between the other portion of the holder member and the rotation member is configured to be varied as the rotation member rotates about the holder body. A guide area may be surrounded by a tube or cylindrical shape portion extending in a direction; and a coupling area may be formed on a side of the tube or cylindrical shape portion and configured to expose the guide area to an external space. One or more first guide protrusions may extend away from each other from two opposite sides of the rotation member, and the first guide protrusions may be configured to move along an arc trajectory in the holder body. The holder body may include an upper body; a guide recess formed in a surface of the upper body; a lower body coupled with the upper body to at least partially face the upper body; and a second guide protrusion disposed on the lower body and at least partially received in the guide recess. The first guide protrusions may be configured to move along the arc trajectory in the guide recess while being supported by the second guide protrusion. The holder body may be detachably disposed on a housing of the wearable electronic device between the housing and a support rod of the wearable electronic device. The holder body may be disposed on the housing, the rotation member is configured to be disposed to surround at least a portion of the support rod to pivot around the support rod.

In an embodiment, a wearable electronic device may include a housing; a support rod disposed to be spaced apart from a side surface of the housing; and at least one wearing member connected to at least a portion of the housing and configured to detachably fasten the housing or the electronic device to a user's body, the at least one wearing member including: a holder body detachably disposed on the housing between the housing and the support rod; a holder member fixed to the holder body; and a rotation member pivotably coupled to the holder body, the holder member including a fixing portion at least partially exposed to a side of the holder body and configured to tightly contact a side surface of the housing. The holder member may further include a support provided to an end of the fixing portion; and the support may be exposed to another side of the holder body and configured to tightly contact the support rod. The holder member may be formed of an elastic material. While the holder body is disposed on the housing, the rotation member is configured to be disposed to surround at least a portion of the support rod to pivot around the support rod. A portion of the holder member and the rotation member may be disposed to face each other while the holder body is disposed on the housing, and the support rod is configured to be exposed to an outside through a gap between the portion of the holder member and the rotation member. As the rotation member pivots about the holder body, the gap between the portion of the holder member and the rotation member varies within a predetermined range. The range in which the gap between the portion of the holder member and the rotation member is varied is at least partially smaller than a diameter of a cross section of the support rod or a diagonal length of the cross section of the support rod. The wearing member further may include a strap extending from the rotation member. The wearing member further may include a first guide protrusion extending from at least a side of the rotation member, and the first guide protrusion moves in an arc trajectory around the support rod as the rotation member pivots about the holder body. The holder body may include: an upper body; a guide recess formed in a surface of the upper body; a lower body coupled with the upper body, the lower body at least partially face the upper body; and a second guide protrusion disposed on the lower body and at least partially received in the guide recess. The first guide protrusion may be configured to move along the arc trajectory in the guide recess while being supported by the second guide protrusion. The wearing member may include a pair of first guide protrusions, and the holder member is selectively positioned between the first guide protrusions as the wearing member pivots about the holder body. The rotation member may include a guide area receiving the support rod while at least partially surrounding an outer circumference surface of the support rod, and a coupling area exposing at least a portion of the guide area to an outside. At least a portion of the holder member and at least a portion the rotation member are disposed to face each other, the support rod being exposed to an outside through a gap between the portion of the holder member and the rotation member, the gap including at least a portion of the coupling area.

According to certain embodiments of the disclosure, a wearing member and/or a wearable electronic device including the same may comprise a holder body, a holder member fixed to the holder body, and a rotation member pivotably disposed on the holder body. The holder member may have a portion protruding from a surface of the holder body, on a side of the holder body, and another portion disposed to be exposed to another side of the holder body to face the rotation member.

According to certain embodiments of the disclosure, a wearable electronic device may comprise a housing, a support rod disposed to be spaced apart from a side surface of the housing, and at least one wearing member connected to at least a portion of the housing and configured to detachably fasten the housing or the electronic device to a user's body. The wearing member may include a holder body detachably disposed on the housing between the housing and the support rod, a holder member fixed to the holder body, and a rotation member pivotably coupled to the holder body. The holder member may include a fixing portion at least partially exposed to a side of the holder body and configured to tightly contact a side surface of the housing.

According to certain embodiments of the disclosure, a wearable electronic device may comprise a housing, a support rod disposed to be spaced apart from a side surface of the housing, and at least one wearing member connected to at least a portion of the housing and configured to detachably fasten the housing or the electronic device to a user's body. The wearing member may include a holder body detachably disposed on the housing between the housing and the support rod, a holder member fixed to the holder body and configured to tightly contact a side surface of the housing on a side of the holder body and tightly contact the support rod on another side of the holder body, and a rotation member pivotably coupled to the holder body. As the holder body is coupled to the housing, the rotation member may be configured to gradually receive at least a portion of the support rod and, while the holder body is coupled to the housing, the rotation member may be configured to pivot around the support rod while surrounding the outer circumference surface of the support rod.

According to certain embodiments of the disclosure, the wearing member may be stably fixed to the housing by the elastic force or frictional force provided by the holder member. It is possible to facilitate lightness and maintain a stable attached state in attaching the wearing member to the housing. In another embodiment, the wearing member may easily be removed depending on the pivoted angle or position of the strap or rotation member on the holder body. For example, the wearing member and the housing may remain stably attached, and the user herself may easily replace the wearing member. Thus, the user may select and use a wearing member according to her own preference.

These and other aspects for the present disclosure are described in greater detail herein with reference to the accompanying drawings. One of ordinary skill in the art will recognize that the embodiments described and/or illustrated are merely exemplary and should not be construed as limiting the scope of the present invention.

BRIEF DESCRIPTION OF THE DRAWINGS

The foregoing and other aspects, configurations, and/or advantages of certain embodiments of the disclosure will be more apparent from the following detailed description taken in conjunction with the accompanying drawings.

Throughout the drawings, like reference numerals may be assigned to like parts, components, and/or structures.

DETAILED DESCRIPTION

Figure 1:
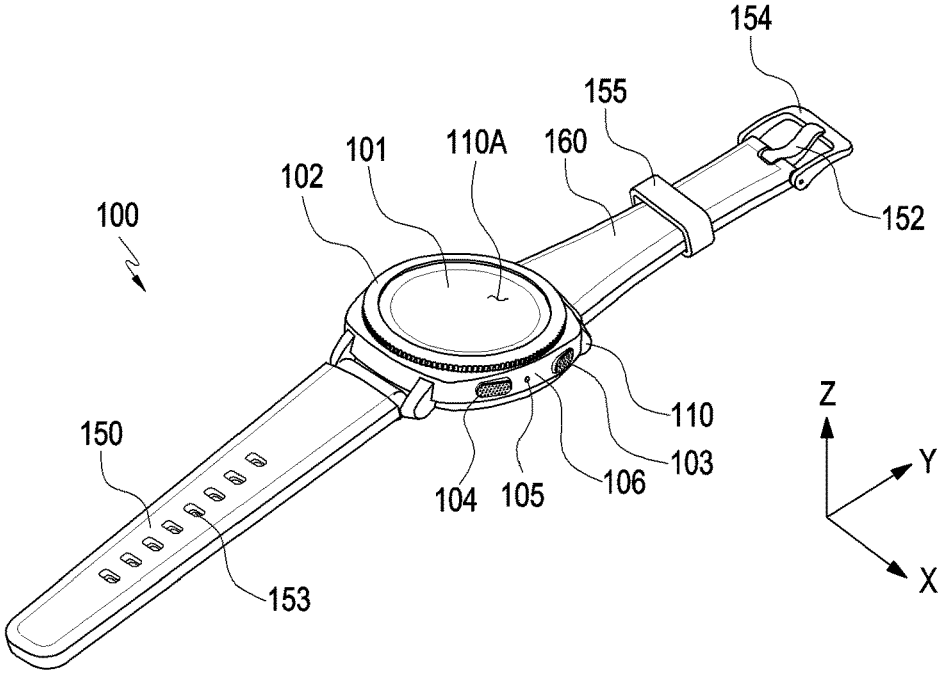
FIG. 1 is a front perspective view illustrating a wearable electronic device according to certain embodiments of the disclosure.

The following description taken in conjunction with the accompanying drawings may be presented to provide a comprehensive understanding of certain implementations of the disclosure as defined by the claims and equivalents thereto. The specific embodiments disclosed in the following description entail certain specific details to aid understanding, but are regarded as one of certain embodiments. Accordingly, it will be apparent to those skilled in the art that certain changes and modifications may be made to the certain implementations described in the disclosure without departing from the scope and spirit of the disclosure. Further, descriptions of well-known functions and configurations may be omitted for clarity and brevity.

The terms and words used in the following description and claims are not limited to the bibliographical meaning, but may be used to clearly and consistently describe the certain embodiments of the disclosure. Therefore, it will be apparent to those skilled in the art that the following description of certain embodiments of the disclosure is provided only for the purpose of description, not for the purpose of limiting the disclosure defined as the scope of the claims and equivalent thereto.

The singular forms "a," "an," and "the" are intended to include the plural forms as well, unless the context clearly indicates otherwise. Thus, as an example, "a component surface" may be interpreted as including one or more of the surfaces of a component.

The electronic device according to certain embodiments may be one of certain types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic device is not limited to the above-listed embodiments.

It should be appreciated that certain embodiments of the present disclosure and the terms used therein are not intended to limit the technological features set forth herein to particular embodiments and include certain changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program) including one or more instructions that are stored in a storage medium (e.g., internal memory or external memory) that is readable by a machine (e.g., the electronic device). For example, a processor (e.g., the processor) of the machine (e.g., the electronic device) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to certain embodiments of the disclosure may be included and provided in a computer program product. The computer program products may be traded as commodities between sellers and buyers. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to certain embodiments, each component (e.g., a module or a program) of the above-described components may include a single entity or multiple entities. Some of the plurality of entities may be separately disposed in different components. According to certain embodiments, one or more of the above-described components may be omitted, or one or more other components may be added. Alternatively or additionally, a plurality of components (e.g., modules or programs) may be integrated into a single component. In such a case, according to certain embodiments, the integrated component may still perform one or more functions of each of the plurality of components in the same or similar manner as they are performed by a corresponding one of the plurality of components before the integration. According to certain embodiments, operations performed by the module, the program, or another component may be carried out sequentially, in parallel, repeatedly, or heuristically, or one or more of the operations may be executed in a different order or omitted, or one or more other operations may be added.

Figure 2:
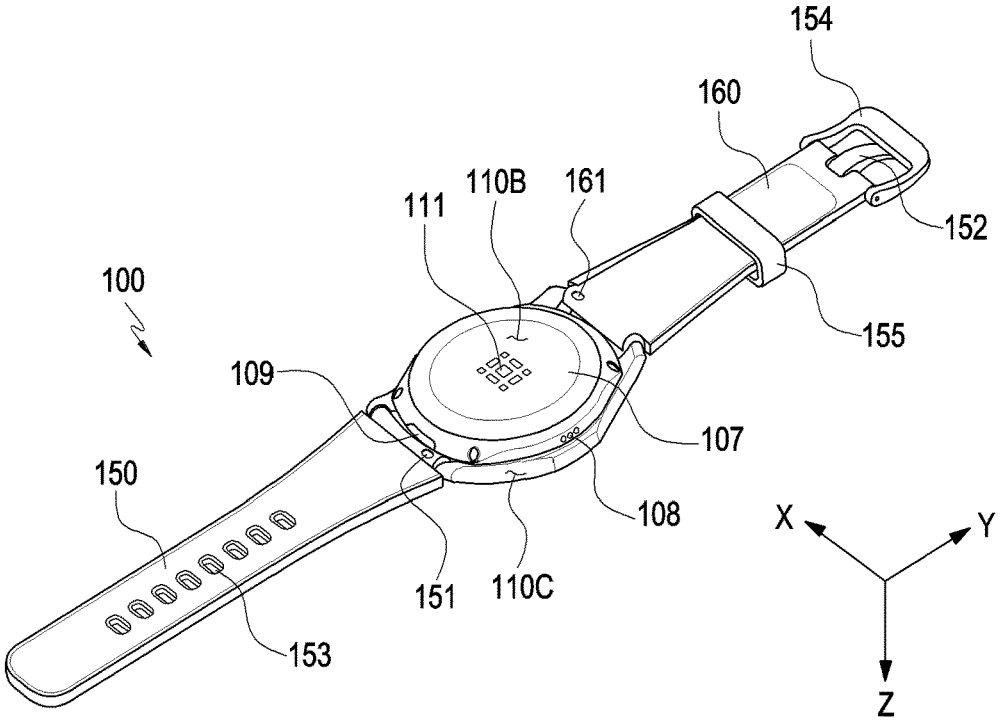
FIG. 2 is a rear perspective view illustrating the wearable electronic device of FIG. 1.

FIG. 1 is a front perspective view illustrating a wearable electronic device 100 according to certain embodiments of the disclosure. FIG. 2 is a rear perspective view illustrating the wearable electronic device 100 of FIG. 1.

Figure 3:
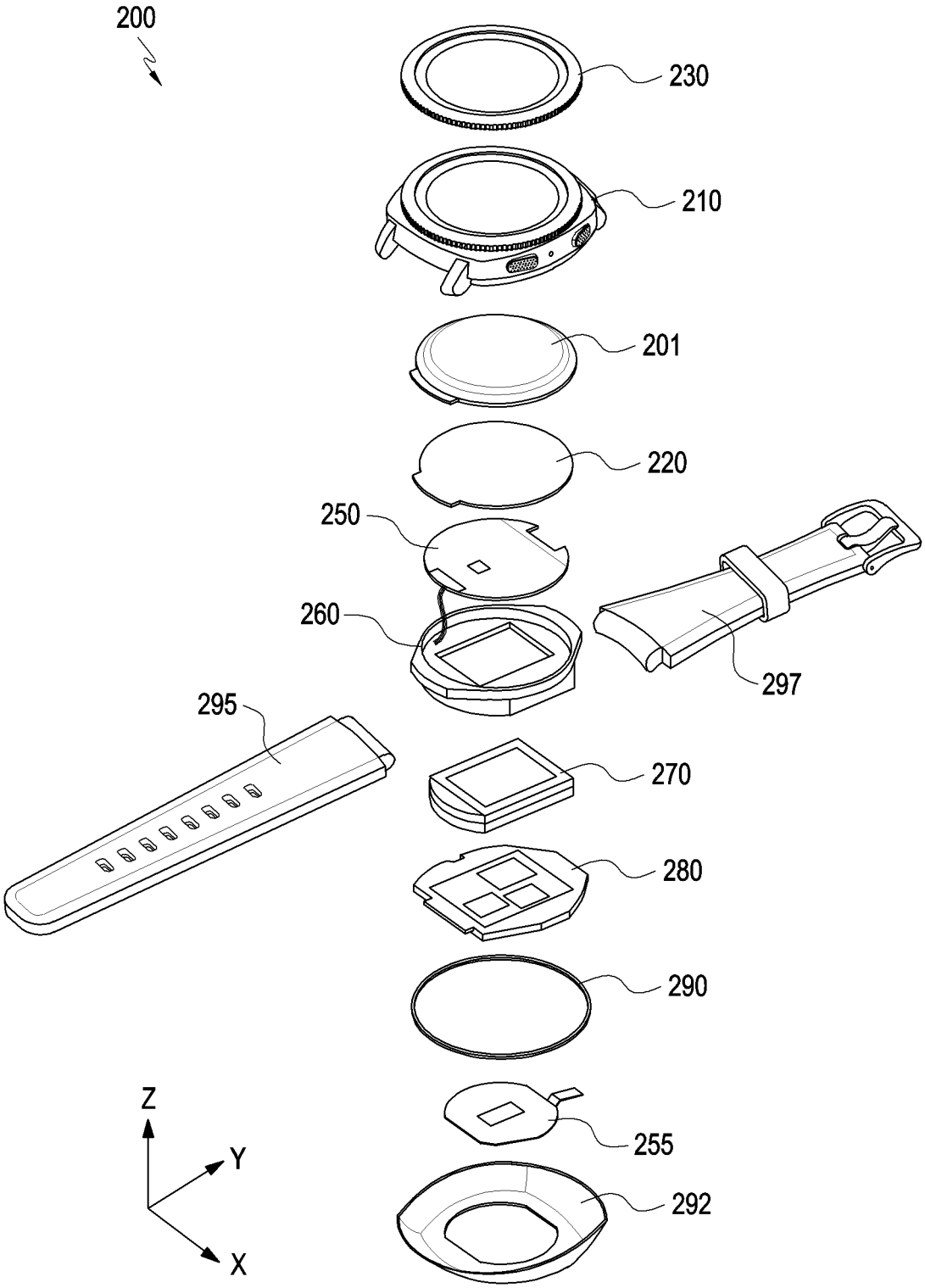
FIG. 3 is an exploded perspective view illustrating the wearable electronic device of FIG. 1.

In the following detailed description, in the orthogonal coordinate system as depicted in FIGS. 1 to 3, 'X-axis direction' may mean the width direction of the electronic device 100 or the housing 110, 'Y-axis direction' may mean the length direction of the electronic device 100 or the housing 110, and 'Z-axis direction' may mean the thickness direction of the electronic device 100 or the housing 110. In an embodiment, the direction in which the front surface (e.g., the first surface 110A of FIG. 1) of the electronic device 100 or the housing 110 faces may be defined as a 'first direction' or a '+Z direction', and the direction in which the rear surface (e.g., the second surface 110B of FIG. 2) of the electronic device 100 or the housing 110 faces may be defined as a 'second direction' or a '−Z direction'.

Referring to FIGS. 1 and 2, according to an embodiment, a wearable electronic device 100 may include a housing 110 including a first surface (or front surface) 110A, a second surface (or rear surface) 110B, and a side surface 110C surrounding the space between the first surface 110A and the second surface 110B and wearing members 150 and 160 connected to at least part of the housing 110 and configured to allow the electronic device 100 to be removably worn on the user's body portion (e.g., the user's wrist or ankle). For example, the wearable electronic device 100 may be of a wristwatch type. According to another embodiment (not shown), the housing may denote a structure forming the first surface 110A of FIG. 1, the second surface 110B of FIG. 2, and some of the side surfaces 110C. According to an embodiment, the first surface 110A may be formed by a front plate 101 (e.g., a glass plate or polymer plate with certain coat layers) at least part of which is substantially transparent. The second surface 110B may be formed by a rear plate 107 that is substantially opaque. According to an embodiment, when the electronic device may include a sensor module 111 disposed on the second surface 110B, the rear plate 107 may at least partially include a transparent area. The rear plate 107 may be formed of, e.g., laminated or colored glass, ceramic, polymer, metal (e.g., aluminum, stainless steel (STS), or magnesium), or a combination of at least two thereof. The side surface 110C may be formed by a side bezel structure (or a "side member") 106 that couples to the front plate 101 and the rear plate 107 and includes a metal and/or polymer. According to an embodiment, the rear plate 107 and the side bezel plate 106 may be integrally formed together and include the same material (e.g., a metal, such as aluminum). The wearing members 150 and 160 may be formed of certain materials in certain shapes. A uni-body structure or multiple unit links which is flexible may be formed of fabric, leather, rubber, urethane, metal, ceramic, or a combination of at least two thereof.

According to an embodiment, the electronic device 100 may include at least one or more of a display 220 (refer to FIG. 3), audio modules 105 and 108, a sensor module 111, key input devices 102, 103, and 104, and a connector hole 109. According to an embodiment, the electronic device 100 may exclude at least one of the components, e.g., the key input devices 102, 103, and 104, the connector hole 109, or the sensor module 111, or may add other components.

The display (e.g., the display 220 of FIG. 3) may be exposed through a significant portion of the front plate 101. The display 220 may have a shape corresponding to the shape of the front plate 101, e.g., a circle, ellipse, or polygon. The display 220 may be coupled with, or disposed adjacent, a touch detection circuit, a pressure sensor capable of measuring the strength (pressure) of touches, and/or fingerprint sensor.

A microphone hole 105 may have a microphone inside to obtain external sounds. According to an embodiment, there may be a plurality of microphones to be able to detect the direction of a sound. Ae speaker hole 108 may be used for an external speaker or a receiver for phone talks. According to an embodiment, a speaker may be included without the speaker hole (e.g., a piezo speaker).

The sensor module 111 may produce an electrical signal or data value corresponding to the internal operation state or external environment state of the electronic device 100. The sensor module 111 may include, e.g., a biometric sensor module 111 (e.g., a heartrate monitor (HRM) sensor) disposed on the second surface 110B of the housing 110. The electronic device 100 may further include sensor modules not shown, e.g., at least one of a gesture sensor, a gyro sensor, an atmospheric pressure sensor, a magnetic sensor, an acceleration sensor, a grip sensor, a color sensor, an infrared (IR) sensor, a biometric sensor, a temperature sensor, a humidity sensor, or an illuminance sensor.

The key input devices 102, 103, and 104 may include a wheel key that is disposed on the first surface 110A of the housing 110 to be rotatable in at least one direction and/or key buttons 103 and 104 disposed on the side surface 110C of the housing 110. The key input device 102 may have a shape corresponding to the shape of the front plate 101. According to an embodiment, the electronic device 100 may exclude all or some of the above-mentioned key input devices 102, 103, and 104 and the excluded key input devices 102, 103, and 104 may be implemented in other forms, e.g., as soft keys on the display 220. The connector hole 109 may receive a connector (e.g., a universal serial bus (USB) connector) for transmitting and receiving power and/or data to/from an external electronic device. Another connector hole (not shown) may be included for receiving a connector for transmitting and receiving audio signals to/from the external electronic device. The electronic device 100 may further include a connector cover (not shown) to cover at least part of, e.g., the connector hole 109 and preventing undesirable materials from entering the connector hole.

The wearing members 150 and 160 may detachably be fastened to at least portions of the housing 110 via locking members 151 and 161. The locking members 151 and 161 may include components or parts for coupling, such as pogo pins, and, according to an embodiment, may be replaced with protrusions or recesses formed on/in the wearing members 150 and 160. For example, the wearing members 150 and 160 may be coupled in such a manner as to be fitted into or over the recesses or protrusions formed on the housing 110. The wearing members 150 and 160 may include one or more of a fastening member 152, fastening member coupling holes 153, a band guide member 154, and a band fastening ring 155.

The fastening member 152 may be configured to allow the housing 110 and the wearing members 150 and 160 to be fastened to the user's body portion (e.g., wrist or ankle). The fastening member coupling holes 153 may fasten the housing 110 and the wearing members 150 and 160 to the user's body portion, corresponding to the fastening member 152. The band guide member 154 may be configured to restrict movement of the fastening member 152 to a certain range when the fastening member 152 fits into one of the fastening member coupling holes 153, thereby allowing the wearing members 150 and 160 to be tightly fastened onto the user's body portion. The band fastening ring 155 may limit the range of movement of the wearing members 150 and 160, with the fastening member 152 fitted into one of the fastening member coupling holes 153.

FIG. 3 is an exploded perspective view illustrating the wearable electronic device of FIG. 1.

Referring to FIG. 3, a wearable electronic device 200 may include a side bezel structure 210, a wheel key 230, a front plate 201 (e.g., the front plate 101 of FIG. 1), a display 220, a first antenna 250, a second antenna (e.g., the antenna included in the second circuit board 255), a supporting member 260 (e.g., a bracket), a battery 270, a printed circuit board 280, a sealing member 290, a rear plate 292, and wearing members 295 and 297. At least one of the components of the electronic device 200 may be the same or similar to at least one of the components of the electronic device 100 of FIG. 1 or 2 and no duplicate description is given below. The supporting member 260 may be disposed inside the electronic device 200 to be connected with the side bezel structure 210 or integrated with the side bezel structure 210. The supporting member 260 may be formed of, e.g., a metal and/or non-metallic material (e.g., polymer). The display 220 may be joined onto one surface of the supporting member 260, and the printed circuit board 280 may be joined onto the opposite surface of the supporting member 274. A processor, memory, and/or interface may be mounted on the printed circuit board 280. The processor may include one or more of, e.g., a central processing unit, an application processor, a graphic processing unit (GPU), a sensor processor, or a communication processor.

The memory may include, e.g., a volatile or non-volatile memory. The interface may include, e.g., a high-definition multimedia interface (HDMI), a universal serial bus (USB) interface, a secure digital (SD) card interface, and/or an audio interface. The interface may electrically or physically connect, e.g., the electronic device 200 with an external electronic device and may include a USB connector, an SD card/multimedia card (MMC) connector, or an audio connector.

The battery 270 may be a device for supplying power to at least one component of the electronic device 200. The battery 189 may include, e.g., a primary cell which is not rechargeable, a secondary cell which is rechargeable, or a fuel cell. At least a portion of the battery 270 may be disposed on substantially the same plane as the printed circuit board 280. The battery 270 may be integrated or detachably disposed inside the electronic device 200.

The first antenna 250 may be disposed between the display 220 and the supporting member 260. The first antenna 250 may include, e.g., a near-field communication (NFC) antenna, a wireless charging antenna, and/or a magnetic secure transmission (MST) antenna. The first antenna 250 may perform short-range communication with an external device, wirelessly transmit/receive power necessary for charging, or transmit magnetic-based signals including payment data or short-range communication signals. According to an embodiment of the present invention, an antenna structure may be formed by a portion or combination of the side bezel structure 210 and/or the supporting member 260.

The second circuit board 255 may be disposed between the circuit board 280 and the rear plate 292. The second circuit board 255 may include, e.g., a near-field communication (NFC) antenna, a wireless charging antenna, and/or a magnetic secure transmission (MST) antenna. For example, the second circuit board 255 may perform short-range communication with an external device, wirelessly transmit/receive power necessary for charging, or transmit magnetic-based signals including payment data or short-range communication signals. According to another embodiment, an antenna structure may be formed of a portion or combination of the side bezel structure 210 and/or the rear plate 292. According to certain embodiments, when the electronic device 200 (e.g., the electronic device 100 of FIGS. 1 and 2) includes a sensor module (e.g., the sensor module 111 of FIG. 2), the sensor circuit disposed on the second circuit board 255 or a sensor element (e.g., a photoelectric conversion element or an electrode pad) separate from the second circuit board 255 may be disposed. For example, an electronic component provided as the sensor module 111 may be disposed between the circuit board 280 and the rear plate 292.

The sealing member 290 may be positioned between the side bezel structure 210 and the rear plate 292. The sealing member 290 may be configured to block moisture or foreign bodies that may enter the space surrounded by the side bezel structure 210 and the rear plate 292, from the outside.

Figure 4:
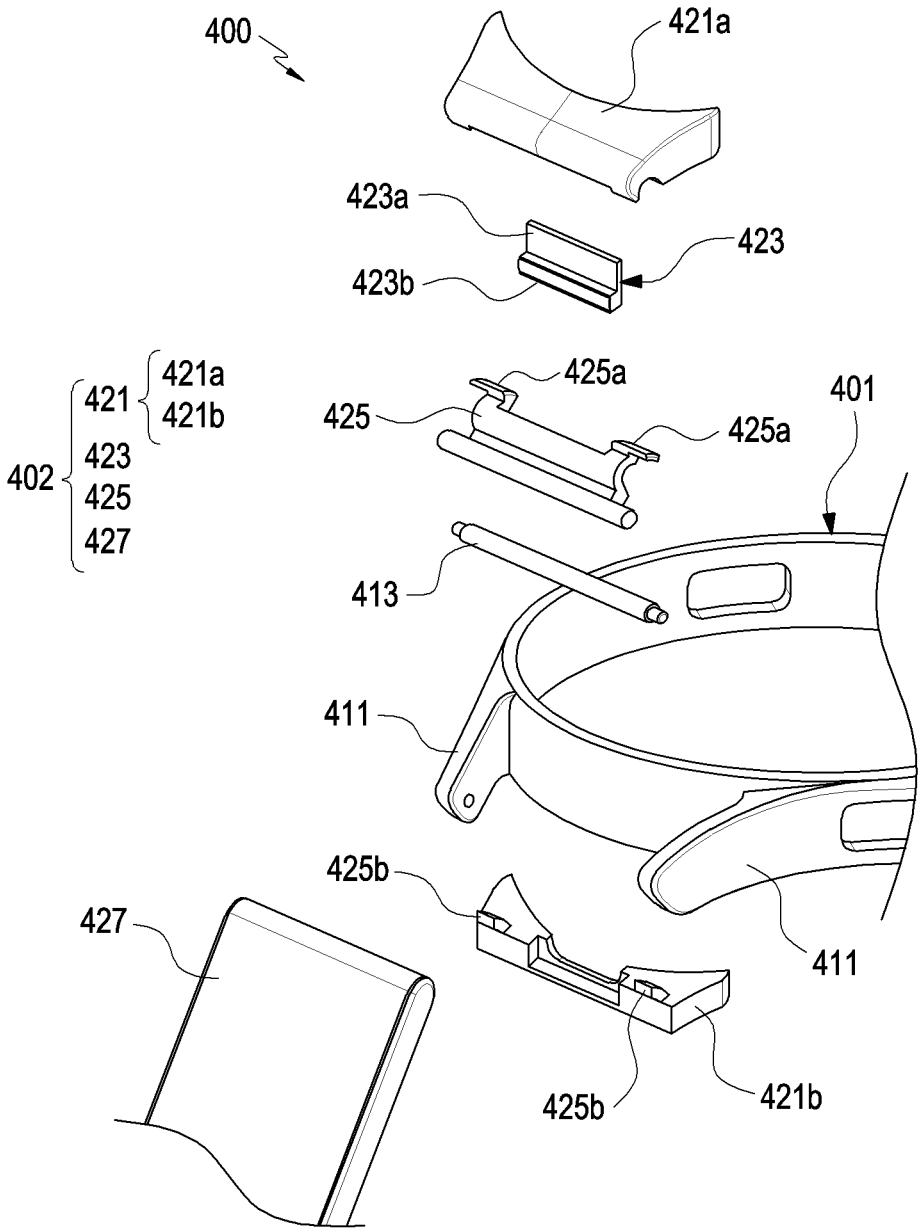
FIG. 4 is an exploded perspective view illustrating a portion of a wearable electronic device according to certain embodiments of the disclosure.
Figure 5:
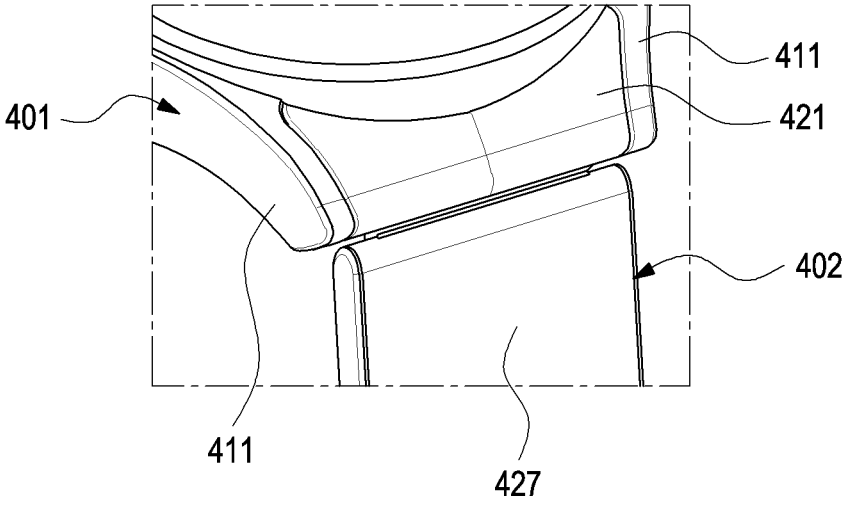
FIG. 5 is a first perspective view illustrating a state in which a wearing member is coupled to a housing in a wearable electronic device according to certain embodiments of the disclosure.

FIG. 4 is an exploded perspective view illustrating a portion of a wearable electronic device 400 (e.g., the electronic device 100 or 200 of FIGS. 1 to 3) according to certain embodiments of the disclosure. FIG. 5 is a first perspective view illustrating a state in which a wearing member 402

Figure 6:
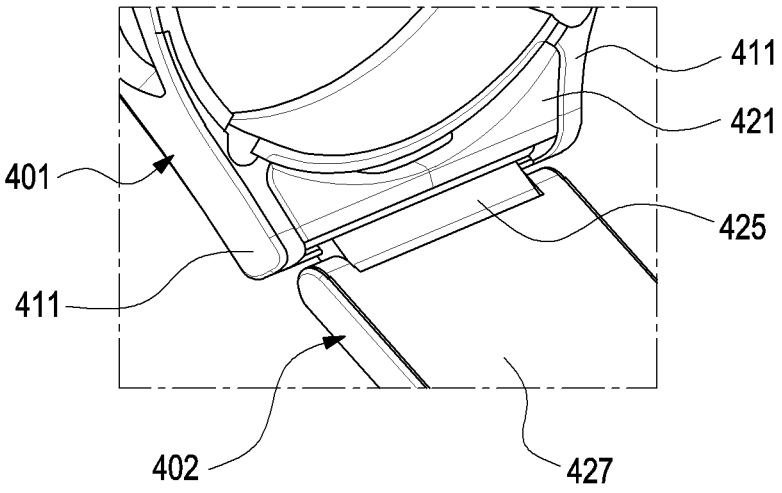
FIG. 6 is a second perspective view illustrating a state in which a wearing member is coupled to a housing in a wearable electronic device according to certain embodiments of the disclosure.

(e.g., the wearing members 150 and 160 of FIG. 1 or 2, or the wearing members 395 and 397 of FIG. 3) is coupled to a housing 401 (e.g., the housing 110 of FIG. 1 or the side bezel structure 210 of FIG. 3) in a wearable electronic device 400 according to certain embodiments of the disclosure. FIG. 6 is a second perspective view illustrating a state in which a wearing member 402 is coupled to a housing 401 of a wearable electronic device 400 according to certain embodiments of the disclosure.

Referring to FIGS. 4 to 6, according to certain embodiments of the disclosure, an electronic device (e.g., the wearable electronic device 400) may include a housing 401, a support rod 413, and/or at least one wearing member 402. The wearing member 402 may be coupled to the housing 401 by including a holder body 421 detachably disposed between the housing 401 and the support rod 413 and may be configured to detachably fasten the housing 401 of the electronic device 400 to the user's body. According to an embodiment, there may be provided a plurality of (e.g., a pair of) wearing members 402 which may be disposed in positions symmetrical with respect to the housing 401. As described in connection with the electronic devices 100 and 200 of FIGS. 1 to 3, the user may wear the electronic device 400 on her body by coupling a pair of wearing members 402.

According to certain embodiments, the housing 401 may be shaped as a frame or cylinder and may be appreciated as including the front plate 101 of FIG. 1 and/or the rear plate 107 of FIG. 2. The support rod 413 and/or the wearing member 402 may be coupled to the electronic device 400 via at least one pair of binding protrusions 411. For example, the binding protrusions 411 may extend from the outer circumference surface of the housing 401 in parallel, spaced apart from each other by the interval corresponding to the width of the wearing member(s) 402, and the support rod 413 or the wearing member 402 may be coupled to the housing 401 through the binding protrusions 411. In an embodiment, when the electronic device 400 includes a pair of wearing members 402, another pair of binding protrusions (not shown) may further be disposed in the positions symmetrical with the binding protrusions 411 shown in FIG. 4.

According to certain embodiments, the support rod 413 may be a component for binding, e.g., a pogo pin, may be disposed apart from a side surface of the housing 401. For example, as two opposite ends of the support rod 413 are bound to the binding protrusions 411, the support rod 413 may be spaced apart from the side surface of the housing 401. The support rod 413 may have a substantially circular or polygonal cross section and, according to an embodiment, the support rod 413 may be integrally formed with the binding protrusions 411 or the housing 401. In an embodiment, the support rod 413 may keep the wearing member 402 bound to the housing 401 and permit pivotal or deformation of the wearing member 402 about the housing 401 to the position corresponding to the user's body curve.

According to certain embodiments, the wearing member 402 may include a holder body 421, a holder member 423, and/or a rotation member 425 and, according to an embodiment, the wearing member 402 may include a strap 427 that extends from the rotation member 425. As is described in connection with FIG. 17, when a pair of wearing members 402 are provided, one wearing member 402 may include the strap 427, and the other wearing member 402 may include the strap 427.

In an embodiment, as the holder member 423 is detachably disposed on the housing 401 between the housing 401 and the support rod 413, the wearing member 402 may be coupled to the housing 401. The rotation member 425 may be pivotably coupled to the holder member 423 and be pivoted around the support rod 413, with the holder member 423 coupled to the housing 401. With the holder member 423 coupled to the housing 401, the holder member 423 may at least partially come in tight contact to a side surface of the housing 401, stably fixing the holder body 421 to the housing 401.

According to certain embodiments, the holder body 421 has one side surface shaped to correspond to the shape of the side surface of the housing 401 and is coupled to surround a portion of the side surface of the housing 401. The holder body 421 may be coupled to surround a portion of the support rod 413 in the state coupled to the housing 401. For example, the holder body 421 may be bound between the side surface of the housing 401 and the support rod 413. According to an embodiment, the holder body 421 may include an upper body 421*a* and a lower body 421*b* coupled to face the upper body 421*a*, and the configuration of the holder member 423 may be diversified according to embodiments. For example, in the illustrated embodiment, the holder body 421 may have a structure that includes the upper body 421*a* and the lower body 421*b*. In the assembled state, the holder body 421 may be implemented to differ from that in the shown embodiment. The assembly structure of the holder body 421, the holder member 423, and/or the rotation member 425 is described further with reference to FIGS. 7 to 9.

According to certain embodiments, the holder member 423 may be formed of an elastic material, such as rubber, silicone, or urethane, and may be fixed to the holder body 421. In an embodiment, the holder member 423 (e.g., a fixing portion 423*a* or the second support 423*d* of FIG. 8) may be at least partially exposed to one side of the holder body 421 and brought in tight contact to the side surface of the housing 401. For example, with the holder body 421 placed on the housing 401, the holder member 423 may tightly contact the side surface of the housing 401. In some embodiments, when the holder member 423 is formed of an elastic material, the holder member 423 may be brought in tight contact with the side surface of the housing 401 and be thus compressed or create static frictional force, stably fixing the holder body 421 to the housing 401.

According to certain embodiments, a portion of the holder member 423 may protrude from the surface of the holder body 421, and a recess (not shown) corresponding to a portion of the holder member 423 may be formed in a side surface of the housing 401. For example, as a portion of the holder member 423 may be engaged to the recess in the side surface of the housing 401, the holder body 421 may more stably be fixed to the housing 401. According to an embodiment, it is possible to provide a static friction or binding force large enough for the user to separate the holder body 421 from the housing 401 while stably maintaining the coupled state between the holder body 421 and the housing 401. For example, given the binding force between the holder body 421 and the housing 401, the material of the holder member 423 or the structure regarding the recess in the side surface of the housing 401 may be appropriately selected.

According to certain embodiments, the holder member 423 may include a fixing portion 423*a* and a first support 423*b*. The fixing portion 423*a* may be at least partially interposed and/or fixed, for example, between the upper body 421*a* and the lower body 421*b*, and a portion of the fixing portion 423*a* may be exposed to one side of the holder body 421. For example, if the holder body 421 is coupled to the housing 401, a portion of the fixing portion 423*a* may come in tight contact with the side surface of the housing 401. In some embodiments, the holder member 423 may further include a second support (e.g., the second support 423*d* of FIG. 8) projecting from any one surface of the fixing portion 423*a*, and the second support 423*d* may come in tight contact with the side surface of the housing 401. For example, the second support 423*d* may be interpreted substantially as a portion of the fixing portion 423*a* and may be brought in tight contact with the side surface of the housing 401, stably fixing the holder body 421 to the housing 401.

According to certain embodiments, the first support 423*b* may be provided at an end (e.g., edge) on the other surface of the fixing portion 423*a* and may be exposed to the other side of the holder body 421 (e.g., the lower body 421*b*). For example, if the holder body 421 is coupled with the housing 401, the first support 423*b* may tightly contact the support rod 413. In some embodiments, as the holder member 423 comes in tight contact with each of the support rod 413 and the side surface of the housing 401, the holder body 421 may be fixed substantially between the side surface of the housing 401 and the support rod 413. In another embodiment, as the holder member 423 is formed of an elastic material, the holder body 421 may be suppressed from moving on the housing 401. For example, as the holder member 423 is compressed to accumulate elastic force with the holder body 421 coupled to the housing 401, the holder body 421 may be suppressed from moving, thereby mitigating or preventing friction with the housing 401 or friction-induced noise.

According to certain embodiments, the rotation member 425 may at least partially be received or coupled in the holder body 421 and pivot about the holder body 421. For example, the rotation member 425 may include a first guide protrusion 425*a* extending at least a side, and the first guide protrusion 425*a* may be movably received in the holder body 421. In some embodiments, if the holder body 421 is coupled to the housing 401, the rotation member 425 may be disposed to surround at least a portion of the support rod 413 and pivot about the holder body 421 while rotating around the support rod 413. For example, when the rotation member 425 pivots about the holder body 421, the first guide protrusion 425*a* may move along the arc trajectory inside the holder body 421. In another embodiment, when the rotation member 425 pivots about the holder body 421, the first guide protrusion 425*a* may be configured to move along the arc trajectory around the support rod 413. The moving trajectory of the first guide protrusion 425*a* may be substantially a portion of the circular centered on the support rod 413. In some embodiments, the rotation member 425 may include a pair of first guide protrusions 425*a*, and the first guide protrusions 425*a* may extend away from each other on two opposite sides or ends of the rotation member 425.

Figure 7:
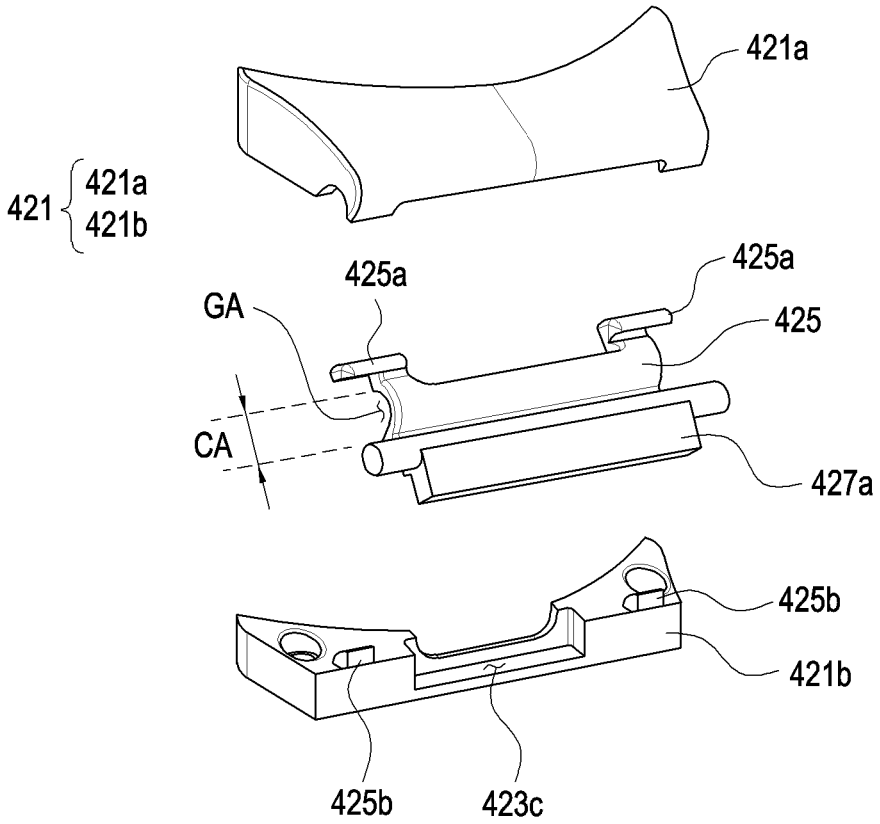
FIG. 7 is an exploded perspective view illustrating a portion of a wearing member of a wearable electronic device according to certain embodiments of the disclosure.
Figure 8:
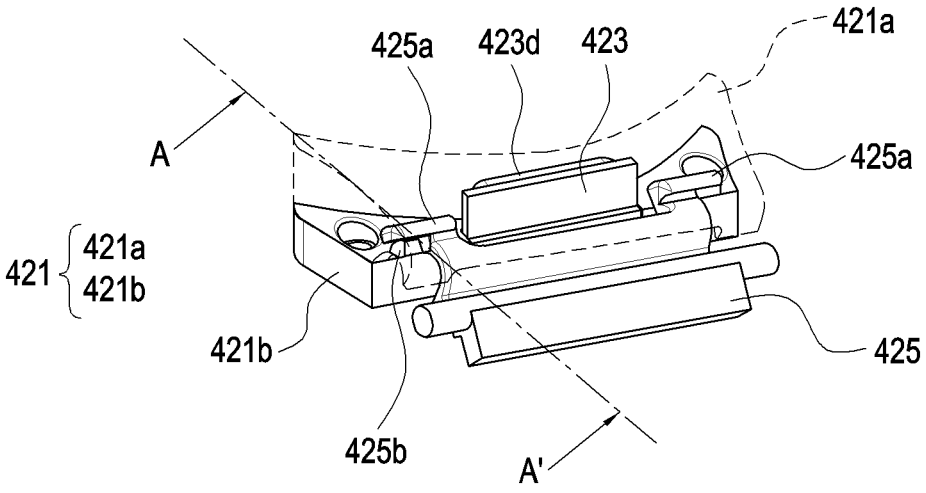
FIG. 8 is a combined perspective view illustrating a portion of a wearing member of a wearable electronic device according to certain embodiments of the disclosure.
Figure 9:
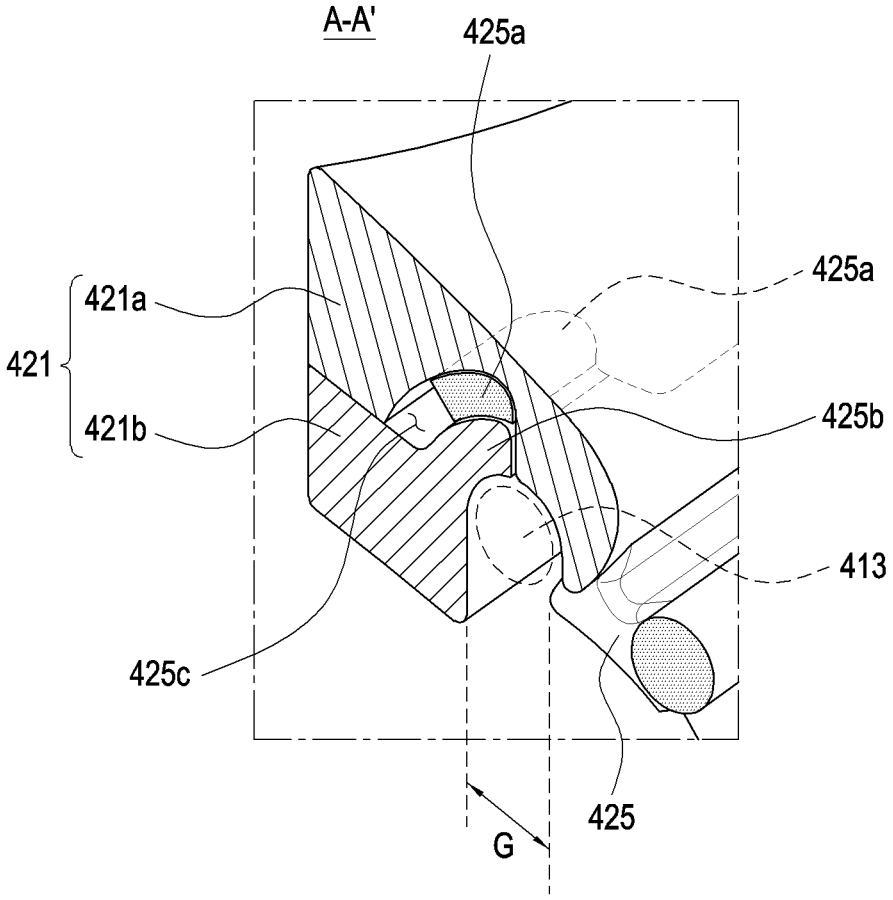
FIG. 9 is a view illustrating a portion of a wearable device taken along line A-A' of FIG. 8.

FIG. 7 is an exploded perspective view illustrating a portion of a wearing member (e.g., the wearing member 402 of FIG. 4) of a wearable electronic device (e.g., the electronic device 100, 200, or 400 of FIGS. 1 to 4) according to certain embodiments of the disclosure. FIG. 8 is a combined perspective view illustrating a portion of a wearing member 402 of a wearable electronic device 400 according to certain embodiments of the disclosure. FIG. 9 is a view illustrating a portion of a wearable device 402 taken along line A-A' of FIG. 8.

Referring further to FIGS. 7 to 9, the wearing member 402 or the holder body 421 may further include a fixing recess 423*c*, at least one guide recess 425*c*, and/or at least one support protrusion (e.g., a second guide protrusion 425*b*). The fixing recess 423*c* is, e.g., a recess for defining the position of the holder member 423 and may be formed in the holder body 421 (e.g., the lower body 421*b*). Although not shown, the holder body 421 may include an additional fixing recess (not shown) to receive another portion of the holder member 423, and the additional fixing recess may be formed in the upper body 421*a*. In some embodiments, the fixing portion 423*a* of the holder member 423 may be substantially received in the fixing recess 423*c*. The first support 423*b* may protrude from the surface of the holder body 421 (e.g., the lower body 421*b*) on a side surface of the holder body 421 facing the support rod 413, and the second support 423*d* may protrude from the surface of the holder body 421 on the side surface facing the housing 401.

According to certain embodiments, the guide recess 425*c* is a recess formed in the surface of the upper body 421*a* on the surface facing the lower body 421*b*, and the bottom surface or inner wall of the guide recess 425*c* may at least partially form an arc trajectory. As is described below, the guide recess 425*c* is a recess to receive the first guide protrusion 425*a* of the rotation member 425. A number of guide recesses 425*c* corresponding to the number of first guide protrusions 425*a* may be formed in the upper body 421*a*. According to an embodiment, the second guide protrusion 425*b* may be formed in the lower body 421*b* and, if the upper body 421*a* and the lower body 421*b* are coupled to face each other, it may be received in any one of the guide recesses 425*c*. In some embodiments, in a state in which the holder member 423 is disposed in the fixing recess 423*c*, and the first guide protrusion 425*a* is disposed in the guide recess 425*c*, the upper body 421*a* and the lower body 421*b* may be coupled to each other. For example, as the fixing portion 423*a* is fixed between the upper body 421*a* and the lower body 421*b*, the holder member 423 may be assembled to the holder body 421 and, in a state in which the first guide protrusion 425*a* is movable in the guide recess 425*c* by the second guide protrusion 425*b*, the rotation member 425 may be coupled to the holder body 421.

According to certain embodiments, the guide recess 425*c* may extend along the arc trajectory where the first guide protrusion 425*a* moves, providing an area or space where the first guide protrusion 425*a* moves. For example, the first guide protrusion 425*a* may be at least partially received between the second guide protrusion 425*b* and the inner wall (or bottom) of the guide recess 425*c*, and be moved along the arc trajectory in the guide recess 425*c* in a state supported by the second guide protrusion 425*b*. The range in which the first guide protrusion 425*a* is movable or the angular range in which the rotation member 425 is pivoted about the holder body 421 may be determined substantially by the length in which the guide recess 425*c* extends and/or the trajectory in which the guide recess 425*c* extends.

According to certain embodiments, the rotation member 425 may be pivotably coupled to the holder body 421 by the first guide protrusion 425*a*. If the holder body 421 is disposed on the housing 401, the support rod 413 is positioned on one side of the lower body 421*b*, and it may come in tight contact with the holder member 423 (e.g., the first support 423*b*), and the rotation member 425 may be disposed to surround at least a portion of the support rod 413. For example, the rotation member 425 may pivot around the support rod 413 or pivot about the holder body 421 while slidingly contacting the support rod 413. In an embodiment, the rotation member 425 may define a tube shape or cylindrical shape, and may extend in a direction substantially parallel to the support rod 413 and may form a guide area GA and may include a coupling area CA to expose the guide area GA to the external space. For example, although the rotation member 425 is shaped substantially as a tube or cylinder, the rotation member 425 may include a side that is open in cross-section view (e.g., the coupling area CA) so that it may not have a closed loop shape. In some embodiments, the guide area GA may mean an area or space surrounded by the tube or cylindrical shape of the rotation member 425, and according to an embodiment, the coupling area CA may be substantially a portion of the guide area GA.

According to certain embodiments, when the wearing member 402 is coupled to the housing 401, the coupling area CA may at least partially function as a path that allows the support rod 413 to enter the guide area GA. In FIG. 9, the gap denoted by 'G' is an example of the path along which the support rod 413 is coupled with the wearing member 402 or enters the guide area GA and it may be appreciated as including at least a portion of the coupling area CA, the interval between the lower body and the rotation member, or the interval between the first support and the rotation member. For example, the rotation member 425 may be disposed, partially apart from, and face, the holder body 421 (e.g., the lower body 421*b*) or the holder member 423 (e.g., the first support 423*b*) by a predetermined gap. The gap G is described in more detail in connection with FIGS. 12 to 15.

Figure 17:
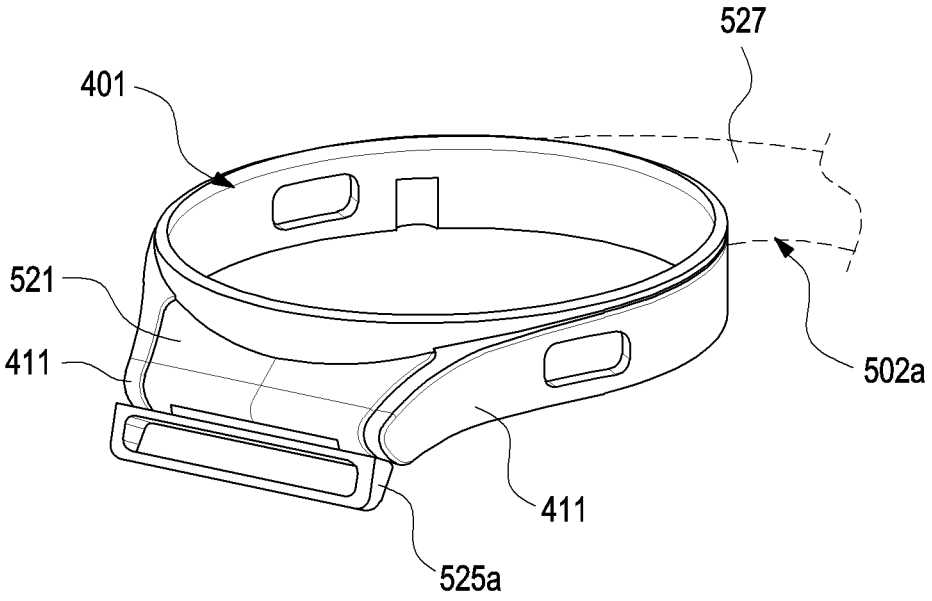
FIG. 17 is a perspective view illustrating another example of a wearing member in a wearable electronic device according to certain embodiments of the disclosure.

According to certain embodiments, a pair of first guide protrusions 425*a* may be disposed on two opposite sides of the rotation member 425 and, when the rotation member 425 is pivoted about the holder body 421, the holder member 423 may selectively be positioned between the first guide protrusions 425*a*. For example, on the holder body 421, the fixing recess 423*c* may be disposed in an area or space defined between the guide recesses 425*c*. The placement of the fixing recess 423*c* or the guide recess 425*c* may be understood through the state in which the holder member 423 is positioned between the first guide protrusions 425*a* in FIG. 8. In an embodiment, the rotation member 425 may further include a fixing piece 427*a* extending from the position spaced apart from the first guide protrusion(s) 425*a*. The fixing piece 427*a* is, e.g., a structure that allows the strap 427 to be coupled to the rotation member 425 and may be implemented in certain manners depending on the type of the strap 427. For example, if the strap 427 is one formed of leather, fabric, or synthetic resin, it may be coupled with the rotation member 425 in a state enclosing the fixing piece 427*a* having the shape shown in FIG. 7. In another embodiment, the strap 427 may have a link or chain structure in which multiple metal segments are connected and, when the strap 427 has a link or chain structure, the fixing piece 427*a* may have a shape or structure similar to the segment(s) constituting the strap 427. In another embodiment, the strap 427 may have a binding structure that uses attaching force, e.g., a hook-and-loop structure such as VELCRO, and in this case, the fixing piece 427*a* may have a ring or frame shape (e.g., refer to the fixing piece 525*a* of FIG. 17). As shown in FIG. 17, the fixing piece 252*a* may extend from a coupling part 521 that is secured to and between opposing ones of the binding protrusions 411.

In the following detailed description, components that may easily be understood through the wearable electronic device 400 according to the above-described embodiments may be assigned the same reference numbers or omit reference numbers, and a detailed description thereof may be omitted. As necessary, the configuration according to the foregoing embodiment may be referenced.

Figure 10:
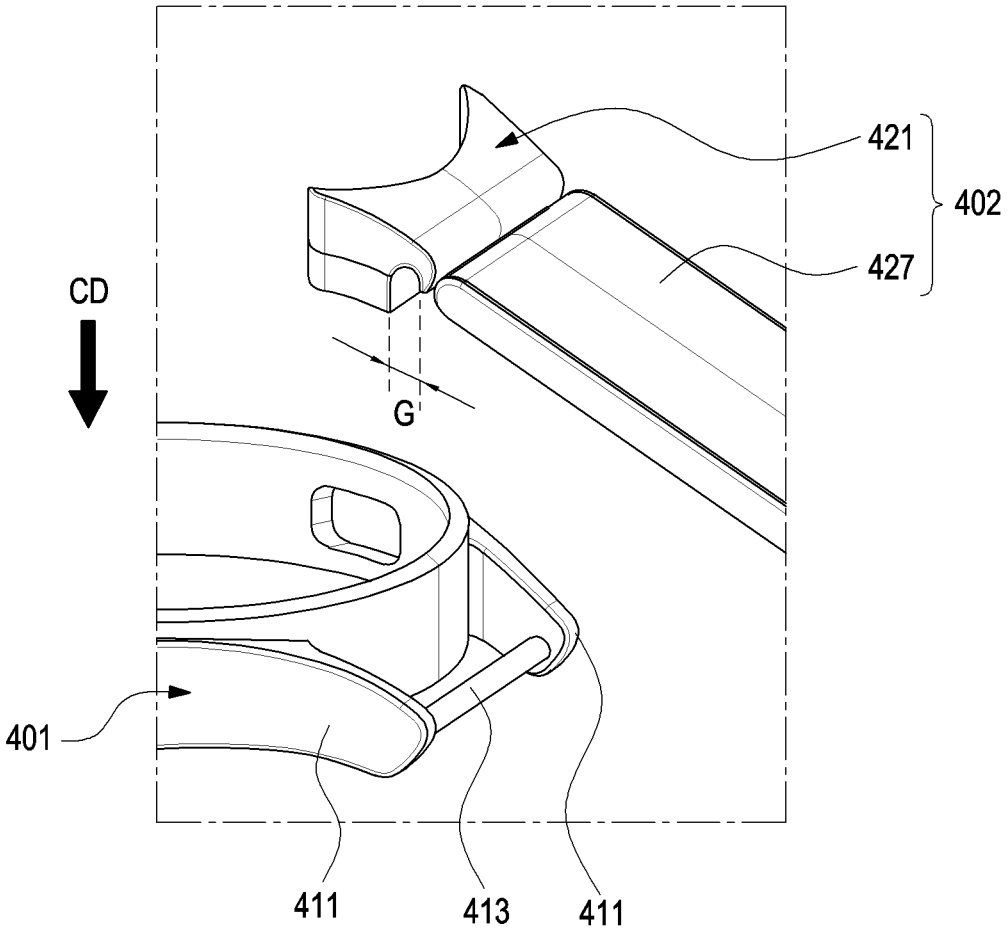
FIG. 10 is an exploded perspective view illustrating a state in which a wearing member is coupled to a housing in a wearable electronic device according to certain embodiments of the disclosure.
Figure 11:
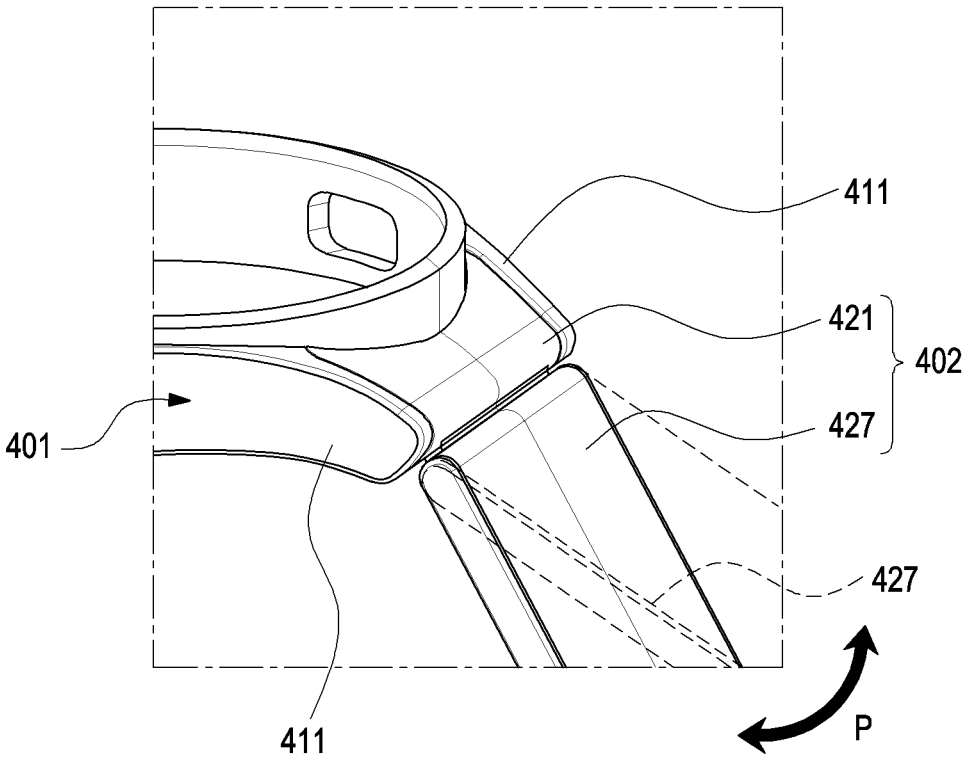
FIG. 11 is a perspective view illustrating a state in which a wearing member is coupled to a housing in a wearable electronic device according to certain embodiments of the disclosure.
Figure 12:
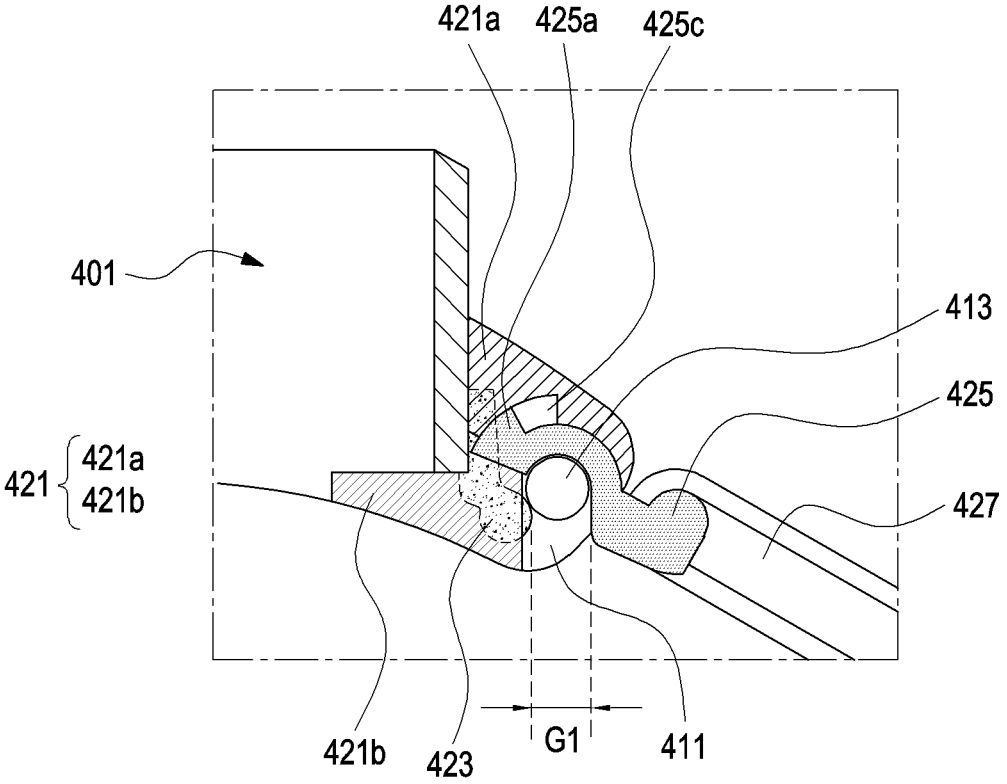
FIG. 12 is a cross-sectional view illustrating a first portion of a wearing member coupled to a housing in a wearable electronic device according to certain embodiments of the disclosure.
Figure 13:
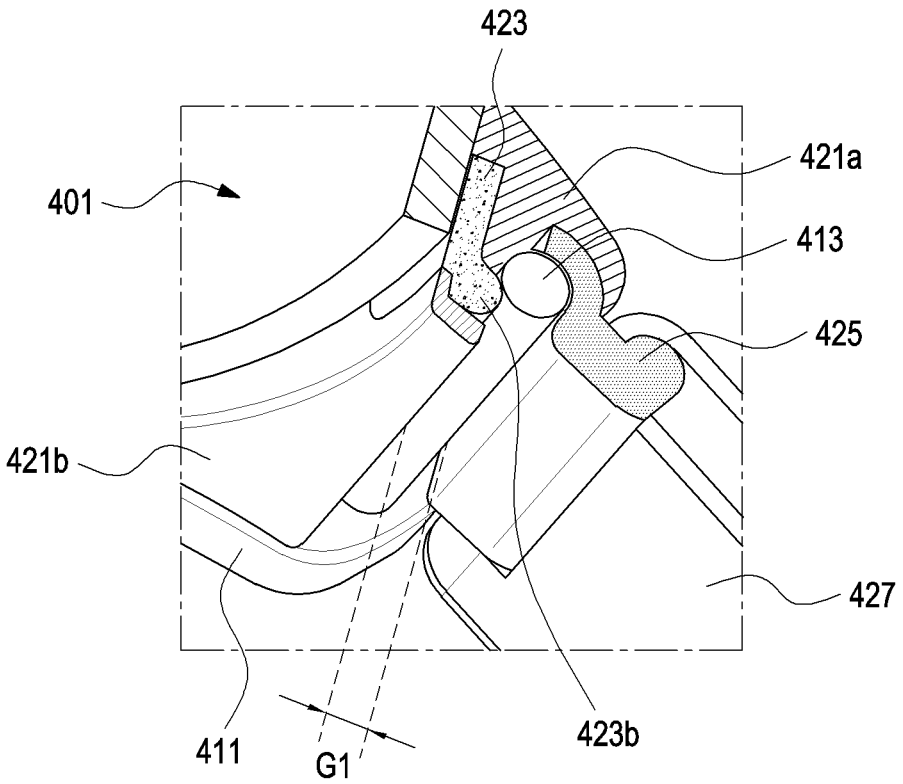
FIG. 13 is a cutout view illustrating a second portion of a wearing member coupled to a housing in a wearable electronic device according to certain embodiments of the disclosure.

FIG. 10 is an exploded perspective view illustrating a state in which a wearing member (e.g., the wearing member 150, 160, 295, 297, or 427 of FIGS. 1 to 4) is coupled to a housing (e.g., the housing 401 of FIGS. 1 to 4) in a wearable electronic device (e.g., the electronic device 100, 200, or 400 of FIGS. 1 to 4) according to certain embodiments of the disclosure. FIG. 11 is a perspective view illustrating a state in which a wearing member 402 is coupled to a housing 401 in a wearable electronic device 400 according to certain embodiments of the disclosure. FIG. 12 is a cross-sectional view illustrating a first portion of a wearing member 402 coupled to a housing 401 in a wearable electronic device 400 according to certain embodiments of the disclosure. FIG. 13 is a cutout view illustrating a second portion of a wearing member 402 coupled to a housing 401 in a wearable electronic device 400 according to certain embodiments of the disclosure.

Referring to FIGS. 10 to 13, a portion of the holder body 421 may be coupled between the side surface of the housing 401 and the support rod 413 along the direction indicated by 'CD.' According to an embodiment, as the rotation member 425 pivots about the holder body 421, the strap 427 may pivot (P) about the housing 401 within a designated angular range and, while the wearing member 402 is coupled to the housing 401, the rotation member 425 may be positioned on the holder body 421 to allow the strap 427 and the housing 401 to remain substantially in parallel with each other. For example, the support rod 413 may enter the guide area GA through the gap (e.g., the gap G of FIG. 9) between the lower body 421*b* and the rotation member 425 or the gap (e.g., the first gap G1 of FIG. 12 or 13) between the holder member 423 (e.g., the first support 423*b*) and the rotation member 425. According to an embodiment, as the strap 427 is rendered to remain substantially in parallel with the housing 401, the strap 427 may easily enter the guide area GA through the first gap G1 between the holder member 423 and the rotation member 425. In some embodiments, the gap G or G1 may include at least a portion of the coupling area CA of the rotation member 425.

According to certain embodiments, while a portion of the holder body 421 enters between the side surface of the housing 401 and the support rod 413, the holder member 423 (e.g., the fixing portion 423*a* or the second support 423*d*) may slidingly contact the side surface of the housing 401. For example, the user may force the holder body 421 to enter between the side surface of the housing 401 and the support rod 413 and, as the holder member 423 is compressed to some degree, it may slidingly contact the side surface of the housing 401. As the holder member 423 is compressed to accumulate elastic force, the holder body 421 may more stably be fixed onto the housing 401. In another embodiment, the gap (e.g., the gap G of FIG. 9 or the first gap G1 of FIG. 12) where the support rod 413 enters the guide area GA may be smaller than the diameter of the cross section of the support rod 413 or the diagonal length of the cross section of the support rod 413. For example, while the holder body 421 is coupled to the housing 401 or the support rod 413 enters the guide area GA, the holder member 423 (e.g., the first support 423*b*) may be compressed to some degree, permitting the support rod 413 to enter the guide area GA and preventing the support rod 413 received in the guide area GA from escaping off.

According to certain embodiments, with the holder body 421 coupled in a proper position between the side surface of the housing 401 and the support rod 413, the holder member 423 (e.g., the fixing portion 423*a* or the second support 423*d*) may tightly contact the side surface of the housing 401, creating static frictional force and hence stably fixing the holder body 421 onto the housing 401. In some embodiments, with the support rod 413 coupled to the guide area GA, the holder member 423 or the first support 423*b* may at least partially come in tight contact with the support rod 413, and the gap (e.g., the first gap G1 of FIG. 12 or 13) between the first support 423*b* and the rotation member 425 may be smaller than that when the holder member 423 (e.g., the first support 423*b*) is compressed (e.g., when the support rod enters the guide area). For example, the holder member 423 may tightly contact the housing 401 or restrict the support rod 413 inside the guide area GA, thereby fixing the holder body 421 to the housing 401.

According to certain embodiments, the user may separate the wearing member 402 or the holder body 421 from the housing 401 by moving the holder body 421 with respect to the housing 401 in the direction opposite to the 'CD' direction of FIG. 10. As the strap 427 is rendered to remain substantially in parallel with the housing 401 in separating the wearing member 402 from the housing 401, the support rod 413 may easily escape from the guide area GA through the first gap G. In some embodiments, while the holder body 421 is separated from the housing 401 or while the support rod 413 escapes from the guide area GA, the holder member 423 may be compressed while slidingly contacting the housing 401 or partially slidingly contacting the support rod 413.

Figure 14:
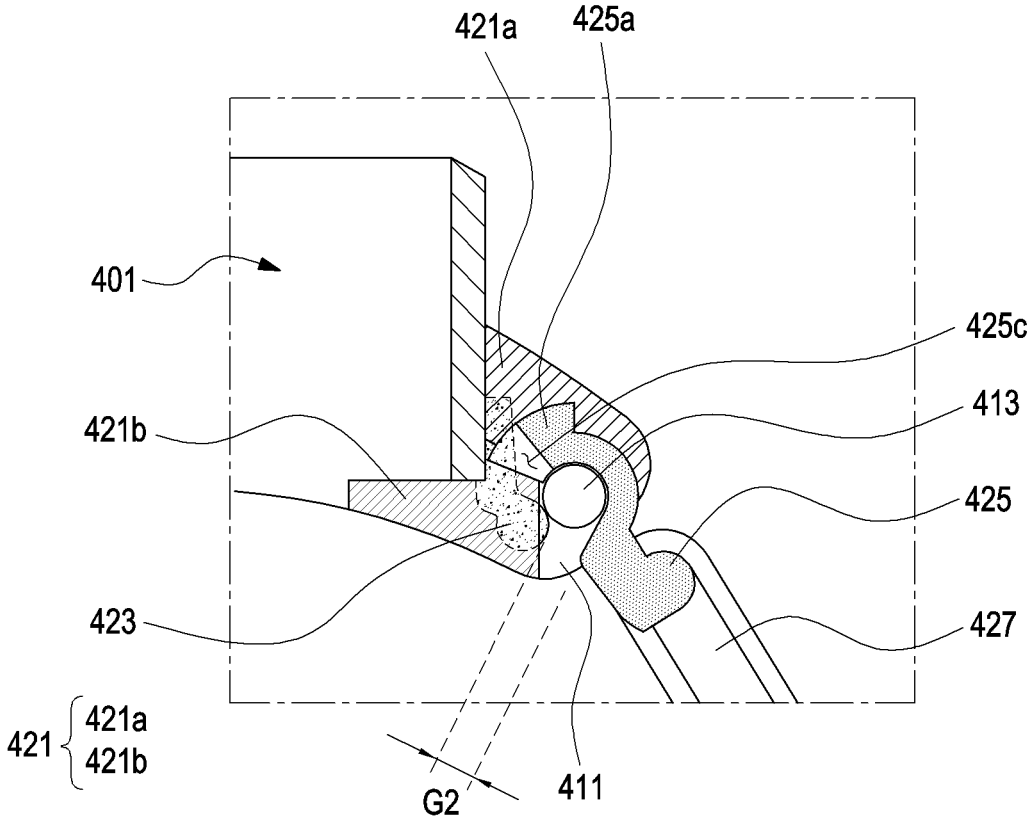
FIG. 14 is a cross-sectional view illustrating a state in which a rotation member or a strap is pivoted about a holder body in the wearable electronic device of FIG. 12.
Figure 15:
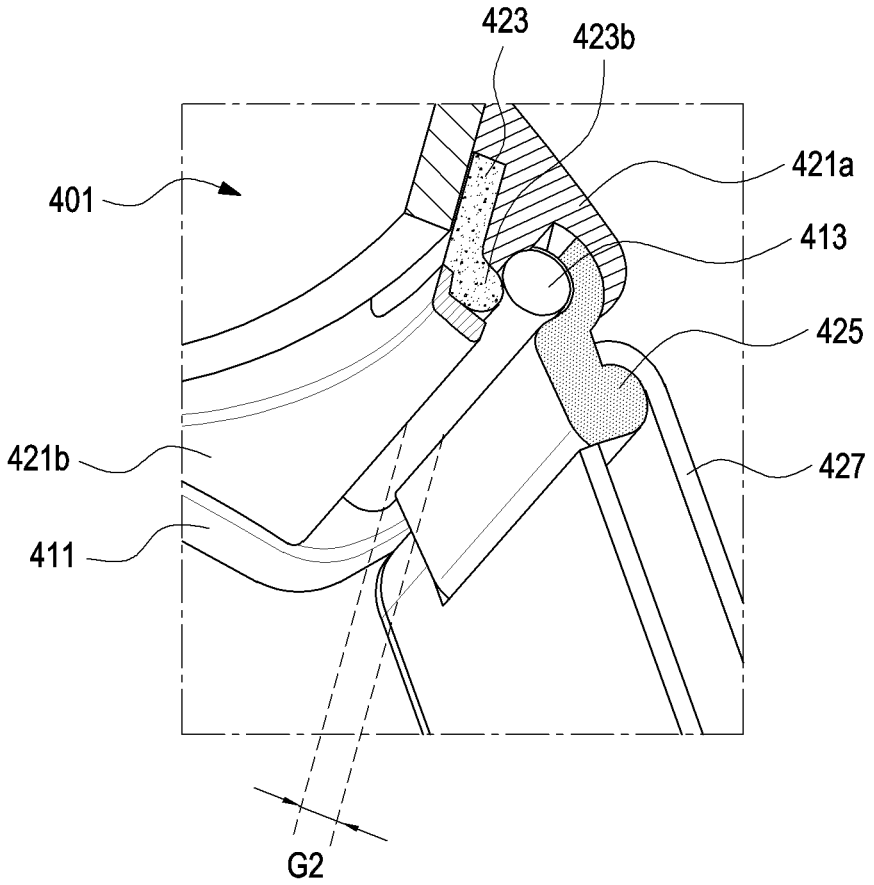
FIG. 15 is a view illustrating a state in which a rotation member or a strap is pivoted about a holder body in the wearable electronic device of FIG. 13.
Figure 16:
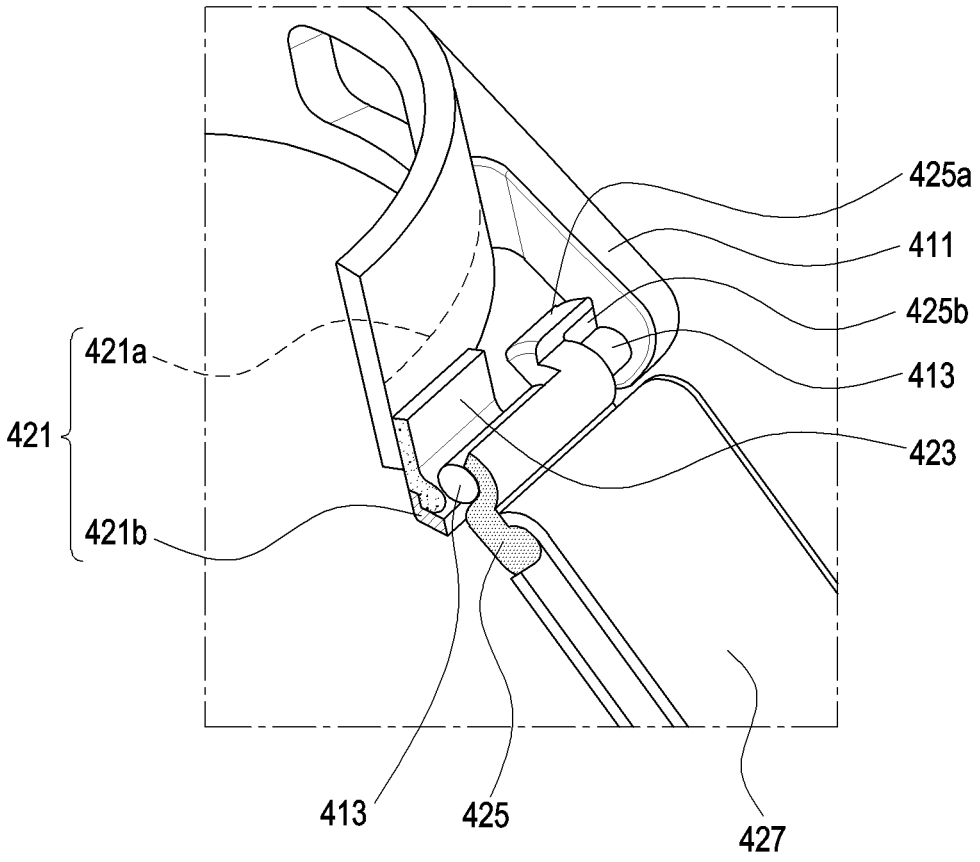
FIG. 16 is a view illustrating the wearable electronic device of FIG. 15, as viewed in a different direction.

FIG. 14 is a cross-sectional view illustrating a state in which a rotation member 425 or a strap 427 is pivoted about a holder body 421 in the wearable electronic device 400 of FIG. 12. FIG. 15 is a view illustrating a state in which a rotation member 425 or a strap 427 is pivoted about a holder body 421 in the wearable electronic device 400 of FIG. 13. FIG. 16 is a view illustrating the wearable electronic device 400 of FIG. 15, as viewed in a different direction.

Referring to FIGS. 14 to 16, in a real use state, e.g., in a state in which the user wears the wearable electronic device 400 on her body (e.g., wrist), the strap 427 may be positioned further inclined with respect to the housing 401 than in the state shown in FIG. 13. For example, a second gap G2 smaller than the first gap G1 may be formed between the lower body 421*b* (or first support 423*b*) and the rotation member 425. For example, the gap between the first support 423*b* and the rotation member 425 may be varied within a designated range as the rotation member 425 pivots, and the range in which the gap is varied may be at least partially smaller than the diameter of the cross section (or the diagonal length of the cross section) of the support rod 413. In some embodiments, if the user wears the electronic device 400 on her body with it received in the guide area GA, the gap between the first support 423*b* and the rotation member 425 is reduced into the second gap G2 so that the support rod 413 may further stably remain restricted on the holder body 421 by the first support 423*b* and the rotation member 425.

According to certain embodiments, although not in the worn state or the strap 427 is positioned substantially in parallel with the housing 401, the holder body 421 may stably be fixed to the housing 401. For example, as the fixing portion 423*a* (or the second support 423*d*) of the holder member 423 tightly contacts the housing 401 and creates static frictional force, and the gap (e.g., the first gap G1 of FIG. 12 or the second gap G2 of FIG. 14) between the first support 423*b* and the rotation member 425 is smaller than the diameter of the cross section of the support rod 413, the support rod 413 may remain restricted to the guide area GA. For example, the support rod 413 is partially exposed through the gap (e.g., the gap G of FIG. 9, the first gap G1 of FIG. 12, or the second gap G2 of FIG. 14) between the holder member 423 (e.g., the first support 423*b*) and the rotation member 425 or at least a portion of the coupling area (e.g., the coupling area CA of FIG. 7) to the outside (e.g., outside of the housing 401 or the wearing member 402) but, since such a gap is smaller than the diameter of the cross section of the support rod 413, the support rod 413 may remain substantially coupled to the holder body 421 as long as no external force is applied.

According to certain embodiments, in a structure of being provided in pair, the wearing members 402 (e.g., the straps 427) may be positioned substantially in parallel with the housing 401 and/or in parallel with each other, in a state coupled to the housing 401. In a state in which the strap 427 is substantially in parallel with the housing 401, the housing 401 may be disposed within a designated distance from, or in contact, on another structure. For example, in a structure of being fed external power in a wireless charging scheme, the wearable electronic device 400 may easily be disposed in the charging position of the wireless charging mount.

As described above, according to certain embodiments of the disclosure, the holder member 423 and/or the rotation member 425 may couple the holder body 421 or wearing member 427 to the housing 401 and provide stable wearability and efficient wireless charging environment. In an embodiment, the holder member 423 may provide a stable fixing structure between the holder body 421 and the housing 401 and/or between the holder body 421 and the support rod 413 while simplifying the structure of binding the wearing member 402 to the housing 401. For example, it is possible to make the wearable electronic device lightweight or compact. In another embodiment, as the rotation member 425 is pivoted on the holder body 421, it is possible to stably maintain the wearing state while facilitating coupling between the support rod 413 and the holder body 421 or replacement of the wearing member 402.

FIG. 17 is a perspective view illustrating another example of a wearing member 502*a* or 502*b* (e.g., the wearing member 402 of FIG. 4) in a wearable electronic device (e.g., the electronic device 400 of FIG. 4) according to certain embodiments of the disclosure.

Referring to FIG. 17, a wearable electronic device 400 may include a pair of wearing members 502*a* and 502*b*. Of the wearing members 502*a* and 502*b*, the first wearing member 502*a* may include a strap 527, and the second wearing member 502*b* may include no strap. According to an embodiment, the first wearing member 502*a* may include a fixing piece 427*a* of FIG. 7 or 8, and the strap 527 may extend from the rotation member or fixing piece (e.g., the rotation member 425 or fixing piece 427*a* of FIG. 7). In some embodiments, the strap 527 may be coupled to surround at least a portion of the fixing piece 427*a* and may include an attaching structure, e.g., a hook-and-loop structure such as VELCRO. In another embodiment, the second wearing member 502*b* may include no strap but may include a ring or frame-shaped fixing piece (hereinafter, 'a second fixing piece 525*a*') different from the fixing piece 427*a* of FIG. 7 or 8. A portion of the strap 527 may pass through the second fixing piece 525*a* and be positioned to face another portion of the strap 527, and two different portions of the strap 527 may be attached to each other through an attaching structure, e.g., a hook-and-loop structure such as VELCRO. For example, the strap 527 may be configured to allow the wearable electronic device 400 to be worn on the user's body by forming a closed loop structure with the housing 401 by being bound to the second fixing piece 525*a*.

As described above, according to certain embodiments of the disclosure, a wearing member (e.g., the wearing member 150, 160, 295, 297, or 427 of FIGS. 1 to 4) and/or a wearable electronic device (e.g., the electronic device 100, 200, or 400 of FIGS. 1 to 4) including the same may comprise a holder body (e.g., the holder body 421 of FIG. 4 or 13), a holder member (e.g., the holder member 423 of FIG. 4 or 13) fixed to the holder body, and a rotation member (e.g., the rotation member 425 of FIG. 4 or 13) pivotably disposed on the holder body. The holder member may have a portion (e.g., the fixing portion 423*a* of FIG. 4 or the second support 423*d* of FIG. 8) protruding from a surface of the holder body, on a side of the holder body, and another portion (e.g., the first support 423*b* of FIG. 4 or 13) disposed to be exposed to another side of the holder body to face the rotation member.

According to certain embodiments, the holder member (e.g., the holder member 423 of FIG. 4 or 13) may include a fixing portion (e.g., the fixing portion 423*a* of FIG. 4 or the second support 423*d* of FIG. 8) fixed to the holder body and at least partially protruding from the surface of the holder body, on the side of the holder body and a support (e.g., the first support 423*b* of FIG. 4 or 13) protruding from a surface of the fixing portion and disposed to be exposed to the other side of the holder body to face the rotation member.

According to certain embodiments, as the rotation member pivots about the holder body, a gap (e.g., the gap G of FIG. 9, the first gap G1 of FIG. 12 or the second gap G2 of FIG. 13) between the other portion of the holder member and the rotation member may be configured to be varied.

According to certain embodiments, the rotation member may include a guide area (e.g., the guide area GA of FIG. 7) surrounded by a tube or cylindrical shape portion extending in a direction and a coupling area (e.g., the coupling area CA of FIG. 7) configured to be formed on a side of the tube or cylindrical shape portion to expose the guide area to an external space.

According to certain embodiments, the wearing member may further comprise first guide protrusions (e.g., the first guide protrusions 425*a* of FIG. 4 or 9) extending away from each other from two opposite sides of the rotation member. The first guide protrusions may be configured to move along an arc trajectory in the holder body.

According to certain embodiments, the holder body may include an upper body (e.g., the upper body 421*a* of FIGS. 7 to 9), a guide recess (e.g., the guide recess 425*c* of FIG. 9) formed in a surface of the upper body, a lower body (e.g., the lower body 421*b* of FIGS. 7 to 9) coupled with the upper body to at least partially face the upper body, and a second guide protrusion (e.g., the second guide protrusion 425*b* of FIGS. 7 to 9) disposed on the lower body and at least partially received in the guide recess. The first guide protrusions may be configured to move along the arc trajectory in the guide recess while being supported by the second guide protrusion.

According to certain embodiments, the holder body may be detachably disposed on a housing, e.g., the housing 110 or 401 of FIG. 1 or 4, of the wearable electronic device, e.g., the electronic device 100, 200, or 400 of FIGS. 1 to 4, which may between the housing and a support rod, e.g., the support rod 413 of FIG. 4 or 13, of the wearable electronic device. While the holder body is disposed on the housing, the rotation member may be configured to be disposed to surround at least a portion of the support rod to pivot around the support rod.

According to certain embodiments of the disclosure, a wearable electronic device, e.g., the electronic device 100, 200, or 400 of FIGS. 1 to 4, may comprise a housing, e.g., the housing 110 or 401 of FIG. 1 or 4, a support rod, e.g., the support rod 413 of FIG. 4 or 13 disposed to be spaced apart from a side surface of the housing, and at least one wearing member, e.g., the wearing member 150, 160, 295, 297, or 427 of FIGS. 1 to 4, which may be connected to at least a portion of the housing and configured to detachably fasten the housing or the electronic device to a user's body. The wearing member may include a holder body, e.g., the holder body 421 of FIG. 4 or 13, which may be detachably disposed on the housing between the housing and the support rod, a holder member, e.g., the holder member 423 of FIG. 4 or 13, which may be fixed to the holder body, and a rotation member, e.g., the rotation member 425 of FIG. 4 or 13, which may be pivotably coupled to the holder body. The holder member may include a fixing portion, e.g., the fixing portion 423*a* of FIG. 4 or the second support 423*d* of FIG. 8, which may be at least partially exposed to a side of the holder body and configured to tightly contact a side surface of the housing.

According to certain embodiments, the holder member may further include a support, e.g., the first support 423*b* of FIG. 4 or 13, which may be provided to an end of the fixing portion. The support may be exposed to another side of the holder body and configured to tightly contact the support rod.

According to certain embodiments, the holder member may be formed of an elastic material including rubber, silicone, or urethane.

According to certain embodiments, while the holder body is disposed on the housing, the rotation member may be configured to be disposed to surround at least a portion of the support rod to pivot around the support rod.

According to certain embodiments, while the holder body is disposed on the housing, a portion of the holder member and the rotation member may be disposed to face each other. The support rod may be configured to be exposed to an outside through a gap, e.g., the gap G of FIG. 9, the first gap G1 of FIG. 12, or the second gap G2 of FIG. 13, which may be between the portion of the holder member and the rotation member.

According to certain embodiments, as the rotation member pivots about the holder body, the gap between the portion of the holder member and the rotation member may be configured to be varied within a designated range.

According to certain embodiments, the range in which the gap between the portion of the holder member and the rotation member is varied may be configured to be at least partially smaller than a diameter of a cross section of the support rod or a diagonal length of the cross section of the support rod.

According to certain embodiments, the wearing member may further include a strap, e.g., the strap 427 of FIG. 4 or 13, which may extend from the rotation member.

According to certain embodiments, the wearing member may further include a first guide protrusion (e.g., the first guide protrusion 425*a* of FIG. 4 or 9) extending from at least a side of the rotation member. The first guide protrusion may be configured to move an arc trajectory around the support rod as the rotation member pivots about the holder body.

According to certain embodiments, the holder body may include an upper body, e.g., the upper body 421*a* of FIGS. 7 to 9, a guide recess, e.g., the guide recess 425*c* of FIG. 9, which may be formed in a surface of the upper body, a lower body, e.g., the lower body 421*b* of FIGS. 7 to 9, which may be coupled with the upper body to at least partially face the upper body, and a second guide protrusion, e.g., the second guide protrusion 425*b* of FIGS. 7 to 9, which may be disposed on the lower body and at least partially received in the guide recess. The first guide protrusions may be configured to move along the arc trajectory in the guide recess while being supported by the second guide protrusion.

According to certain embodiments, the wearing member may include a pair of first guide protrusions. As the wearing member pivots about the holder body, the holder member may be selectively positioned between the first guide protrusions.

According to certain embodiments, the rotation member may include a guide area, e.g., the guide area GA of FIG. 7, which may be receive the support rod while at least partially surrounding an outer circumference surface of the support rod and a coupling area, e.g., the coupling area CA of FIG. 7, which may expose at least a portion of the guide area to an outside.

According to certain embodiments, while the holder body is disposed on the housing, a portion of the holder member and the rotation member may be disposed to face each other. The support rod may be configured to be exposed to the outside through a gap between the portion of the holder member and the rotation member. The gap may include at least a portion of the coupling area.

According to certain embodiments, another portion, e.g., the first support 423*b* of FIG. 4 or 13, of the holder member may be exposed to the other side of the holder body and configured to tightly contact a portion of the support rod, and the rotation member may be disposed to surround the other portion of the support rod and configured to pivot around the support rod.

According to certain embodiments, the support rod may be configured to be exposed to the outside through the gap between the other portion of the holder member and the rotation member, and as the rotation member pivots about the holder body, the gap between the other portion of the holder member and the rotation member may be configured to be varied within a designated range.

According to certain embodiments of the disclosure, a wearable electronic device e.g., the electronic device 100, 200, or 400 of FIGS. 1 to 4, which may comprise a housing, e.g., the housing 110 or 401 of FIG. 1 or 4, a support rod, e.g., the support rod 413 of FIG. 4 or 13, which may be disposed to be spaced apart from a side surface of the housing, and at least one wearing member, e.g., the wearing member 150, 160, 295, 297, or 427 of FIGS. 1 to 4, which may be connected to at least a portion of the housing and configured to detachably fasten the housing or the electronic device to a user's body. The wearing member may include a holder body, e.g., the holder body 421 of FIG. 4 or 13, which may be detachably disposed on the housing between the housing and the support rod, a holder member, e.g., the holder member 423 of FIG. 4 or 13, which may be fixed to the holder body and configured to tightly contact a side surface of the housing on a side of the holder body and tightly contact the support rod on another side of the holder body, and a rotation member, e.g., the rotation member 425 of FIG. 4 or 13, which may be pivotably coupled to the holder body. As the holder body is coupled to the housing, the rotation member may be configured to gradually receive at least a portion of the support rod and, while the holder body is coupled to the housing, the rotation member may be configured to pivot around the support rod while surrounding the outer circumference surface of the support rod.

According to certain embodiments, while the holder body is disposed on the housing, a portion of the holder member and the rotation member may be disposed to face each other. The support rod may be configured to be exposed to an outside through a gap, e.g., the gap G of FIG. 9, the first gap G1 of FIG. 12, or the second gap G2 of FIG. 13, which may be between the portion of the holder member and the rotation member.

According to certain embodiments, the wearing member may include first guide protrusions, e.g., the first guide protrusions 425*a* of FIG. 4 or 9, which may individually extending from two opposite sides of the rotation member, an upper body, e.g., the upper body 421*a* of FIGS. 7 to 9, which may be provided as a portion of the holder body, guide recesses, e.g., the guide recesses 425*c* of FIG. 9, which may be formed in a surface of the upper body, a lower body, e.g., the lower body 421*b* of FIGS. 7 to 9, which may be provided as another portion of the holder body and coupled with the upper body to at least partially face the upper body, and second guide protrusions, e.g., the second guide protrusions 425*b* of FIGS. 7 to 9, which may each be at least partially received in any one of the guide recesses. The first guide protrusions each may be configured to move along an arc trajectory in any one of the guide recesses while being supported by any one among the second guide protrusions.

According to certain embodiments, the wearing members, e.g., wearing members 150 and 160, wearing members 295 and 297, wearing member 402, which may be individually disposed in symmetrical positions with respect to the center of the housing.

According to certain embodiments, the wearing members may further include straps (e.g., the strap 427 of FIG. 4 or 13) extending from the rotation member. As the rotation member pivots about the holder body, the straps may be configured to be selectively aligned in parallel to each other.

While the disclosure has been described and shown in connection with certain embodiments, it should be appreciated that certain embodiments are intended as limiting the invention but as illustrative. It will be apparent to one of ordinary skill in the art that certain changes may be made in form and detail without departing from the overall scope of the disclosure, including the appended claims and their equivalents.

What is claimed is:

1. A wearing member of a wearable electronic device having a housing, the wearing member comprising:

a holder body detachably coupled to the housing of the wearable electronic device, the holder body defining a guide recess;

a holder member including a fixing portion and secured to the holder body to make at least a first portion of the holder member protrude from a surface of the holder body at a first side of the holder body, the first portion of the holder member is configured to be in contact with a side surface of the housing of the wearable electronic device while the holder member being compressed or creating static frictional force to fix the holder body to the housing; and a rotation member that is pivotably coupled to the holder body, the rotation member including a first portion that includes a guide protrusion that engages the guide recess and a second portion that is couplable to a wearable strap, wherein the guide protrusion is configured to move in the guide recess along an arc trajectory, and wherein the rotation member is disposed to surround at least a portion of a support rod of the wearable electronic device.

2. The wearing member of claim 1, wherein the holder member comprises:

a support protruding from a surface of the fixing portion and disposed to be exposed to an other side of the holder body to face the rotation member.

3. The wearing member of claim 1, wherein a gap between an other portion of the holder member and the rotation member is configured to be varied as the rotation member rotates about the holder body.

4. The wearing member of claim 1, wherein the rotation member comprises:

a guide area surrounded by a tube or cylindrical shape portion extending in a direction; and a coupling area formed on a side of the tube or cylindrical shape portion and configured to expose the guide area to an external space.

5. The wearing member of claim 1, wherein the guide protrusion comprising:

two or more first guide protrusions respectively extending away from two opposite sides of the rotation member, wherein the two or more first guide protrusions are configured to move along the arc trajectory in the holder body.

6. The wearing member of claim 5, wherein the holder body comprises:

an upper body;

another guide recess formed in a surface of the upper body;

a lower body coupled with the upper body to at least partially face the upper body; and a second guide protrusion disposed on the lower body and at least partially received in the guide recess, and wherein the two or more first guide protrusions are configured to move along the arc trajectory in the guide recess while being supported by the second guide protrusion.

7. The wearing member of claim 1, wherein:

the holder body is detachably disposed on the housing of the wearable electronic device between the housing and the support rod of the wearable electronic device; and wherein while the holder body is disposed on the housing, the rotation member is configured to be disposed to surround at least a portion of the support rod to pivot around the support rod.

8. A wearable electronic device comprising:

a housing;

a support rod disposed to be spaced apart from a side surface of the housing; and at least one wearing member connected to at least a portion of the housing and configured to detachably fasten the housing or the wearable electronic device to a user's body, the at least one wearing member including a holder body detachably disposed on the housing between the housing and the support rod;

a holder member fixed to the holder body and including a fixing portion at least partially exposed to a side of the holder body; and a rotation member pivotably coupled to the holder body, wherein the holder member is configured to be compressed and tightly contact the side surface of the housing, wherein a guide protrusion of the rotation member is configured to move along an arc trajectory in the holder body, and wherein the rotation member is disposed to surround at least a portion of the support rod and configured to pivot around the support rod.

9. The wearable electronic device of claim 8, wherein:

the holder member further includes a support provided to an end of the fixing portion; and the support is exposed to another side of the holder body and configured to tightly contact the support rod.

10. The wearable electronic device of claim 8, wherein the holder member is formed of an elastic material.

11. The wearable electronic device of claim 8, wherein while the holder body is disposed on the housing, the rotation member is configured to be disposed to surround at least a portion of the support rod to pivot around the support rod.

12. The wearable electronic device of claim 8, wherein a portion of the holder member and the rotation member are disposed to face each other while the holder body is disposed on the housing, and the support rod is configured to be exposed to an outside through a gap between the portion of the holder member and the rotation member.

13. The wearable electronic device of claim 12, wherein as the rotation member pivots about the holder body, the gap between the portion of the holder member and the rotation member varies within a predetermined range.

14. The wearable electronic device of claim 13, wherein a range in which the gap between the portion of the holder member and the rotation member is varied is at least partially smaller than a diameter of a cross section of the support rod or a diagonal length of the cross section of the support rod.

15. The wearable electronic device of claim 8, wherein the at least one wearing member further includes a strap extending from the rotation member.

16. The wearable electronic device of claim 8, wherein the guide protrusion of the rotation member includes a first guide protrusion extending from at least a side of the rotation member, and the first guide protrusion moves in the arc trajectory around the support rod as the rotation member pivots about the holder body.

17. The wearable electronic device of claim 16, wherein the holder body includes:

an upper body;

a guide recess formed in a surface of the upper body;

a lower body coupled with the upper body, the lower body at least partially face the upper body; and a second guide protrusion disposed on the lower body and at least partially received in the guide recess, wherein the first guide protrusion is configured to move along the arc trajectory in the guide recess while being supported by the second guide protrusion.

18. The wearable electronic device of claim 16, wherein the at least one wearing member includes a pair of first guide protrusions, and the holder member is selectively positioned between the first guide protrusions as the at least one wearing member pivots about the holder body.

19. The wearable electronic device of claim 8, wherein the rotation member includes:

a guide area receiving the support rod while at least partially surrounding an outer circumference surface of the support rod; and a coupling area exposing at least a portion of the guide area to an outside.

20. The wearable electronic device of claim 19, wherein at least a portion of the holder member and at least a portion the rotation member are disposed to face each other, the support rod being exposed to the outside through a gap between the portion of the holder member and the rotation member, the gap including at least a portion of the coupling area.

* * * * *